US012497877B2

(12) United States Patent
Chineme et al.

(10) Patent No.: US 12,497,877 B2
(45) Date of Patent: Dec. 16, 2025

(54) END-OF-LIFE RECOVERY OF MOBILIZED HYDROCARBONS

(71) Applicant: Cenovus Energy Inc., Calgary (CA)

(72) Inventors: Emeka Chinedu Chineme, Calgary (CA); Ishan Deep Singh Kochhar, Calgary (CA); David Butterwick, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 19/044,489

(22) Filed: Feb. 3, 2025

(65) Prior Publication Data

US 2025/0250889 A1 Aug. 7, 2025

Related U.S. Application Data

(62) Division of application No. 17/886,988, filed on Aug. 12, 2022, now Pat. No. 12,366,149.

(60) Provisional application No. 63/232,905, filed on Aug. 13, 2021.

(51) Int. Cl.

| | |
|---|---|
| ***E21B 43/24*** | (2006.01) |
| ***E21B 43/14*** | (2006.01) |
| ***E21B 43/16*** | (2006.01) |
| ***E21B 43/30*** | (2006.01) |

(52) U.S. Cl.

CPC ..... *E21B 43/2408* (2013.01); *E21B 43/14* (2013.01); *E21B 43/168* (2013.01); *E21B 43/305* (2013.01)

(58) Field of Classification Search

CPC ..... E21B 43/2408; E21B 43/14; E21B 43/168
USPC ..... 166/272.3
See application file for complete search history.

(56) References Cited

U.S. PATENT DOCUMENTS

| | | | | |
|---|---|---|---|---|
| 1,130,201 | A | 3/1915 | Scarborough | |
| 7,621,326 | B2 * | 11/2009 | Crichlow | E21B 43/24 166/272.5 |
| 9,359,868 | B2 * | 6/2016 | Scott | E21B 36/001 |
| 10,753,188 | B2 * | 8/2020 | Coskuner | E21B 43/24 |
| 2007/0187103 | A1 * | 8/2007 | Crichlow | E21B 43/2408 166/302 |
| 2015/0167436 | A1 * | 6/2015 | Frederick | E21B 43/2406 166/302 |
| 2023/0051011 | A1 | 2/2023 | Chineme et al. | |

OTHER PUBLICATIONS

U.S. Appl. No. 63/232,905, filed Aug. 13, 2021; Chineme et al.

* cited by examiner

*Primary Examiner* — William D Hutton, Jr.
*Assistant Examiner* — Ashish K Varma
(74) *Attorney, Agent, or Firm* — Gordon & Jacobson, P.C.

(57) ABSTRACT

Methods are provided herein for an end-of-life recovery of mobilized hydrocarbons from a stranded hydrocarbon pay zone within a subterranean reservoir by way of a recovery well. In some embodiments, the stranded pay zone is located between mobilized hydrocarbon zones of thermal recovery operations. In some embodiments, the stranded pay zone is an upper stranded pay zone located above a mobilized hydrocarbon zone of a thermal recovery operation. In some embodiments, the stranded pay zone is a lower stranded pay zone located below a mobilized hydrocarbon zone of a thermal recovery operation. The methods herein involve commencing end-of-life recovery at an end-of-life stage after a production threshold is achieved for thermal recovery operations.

19 Claims, 13 Drawing Sheets

Recovered Barrels (Mbbls): 195
Peak Monthly Production (bbl/day): 659
Peak Annualized Production (bbl/d): 151

Recovered Barrels (Mbbls): 187
Peak Monthly Production (bbl/day): 753
Peak Annualized Production (bbl/d): 221

Recovered Barrels (Mbbls): 151
Peak Monthly Production (bbl/day): 612
Peak Annualized Production (bbl/d): 220

END-OF-LIFE RECOVERY OF MOBILIZED HYDROCARBONS

CROSS-REFERENCE TO RELATED APPLICATION(S)

The present disclosure is a divisional application of U.S. patent application Ser. No. 17/886,988, filed on Aug. 12, 2022, which claims priority to U.S. Prov. Patent App. No. 63/232,905, filed on Aug. 13, 2021, both incorporated by reference herein in their entireties.

TECHNICAL FIELD

The present disclosure generally relates to in situ hydrocarbon recovery processes. In particular, the present disclosure relates to methods for producing mobilized hydrocarbons from a stranded pay zone at an end-of-life stage after a production threshold is achieved for a primary recovery process.

BACKGROUND

Hydrocarbons in some subterranean deposits of viscous hydrocarbons can be extracted in situ by lowering the viscosity of the hydrocarbons to mobilize them so that they can be moved to, and recovered from, a production well. Reservoirs of such deposits may be referred to as reservoirs of heavy hydrocarbons, heavy oil, bitumen, or oil sands. In situ processes for recovering oil from oil sands typically involve the use of multiple wells drilled into the reservoir and are assisted or aided by thermal and/or solvent-based recovery techniques, such as injecting a heated fluid, typically steam, solvent or a combination thereof, into the reservoir from an injection well. Steam-assisted gravity drainage (SAGD) and cyclic steam stimulation (CSS) are representative thermal-recovery processes that use steam to mobilize hydrocarbons in situ. Solvent-aided processes (SAP) and solvent-driven processes (SDP) are representative thermal-recovery processes that use both steam and solvent to mobilize hydrocarbons in situ.

A typical SAGD process is disclosed in Canadian Patent No. 1,130,201 issued on 24 Aug. 1982, in which the functional unit involves two wells that are drilled into the deposit, one for injection of steam and one for production of oil and water. Steam is injected via the injection well to heat the formation. The steam condenses and gives up its latent heat to the formation, heating a layer of viscous hydrocarbons. The viscous hydrocarbons are thereby mobilized and drain by gravity toward the production well with an aqueous condensate. In this way, the injected steam initially mobilizes the in-place hydrocarbons to create a steam or production chamber in the reservoir around and above the horizontal segment of the injection and production wells.

The terms "steam chamber" or "production chamber" or "recovery chamber" accordingly refer to the volume of the reservoir which is saturated with injected fluids and from which mobilized oil has at least partially drained. Mobilized viscous hydrocarbons are typically recovered continuously through one or more production wells. The conditions of mobilizing fluid injection and of hydrocarbon production may be modulated to control the growth of the production chamber, for example to maximize oil production at the production well.

In the ramp-up stage of the SAGD process, after communication has been established between the injection and production wells during start-up, production begins from the production well. Steam is continuously injected into the injection well (usually at constant pressure) while mobilized bitumen and water are continuously removed from the production well (usually at constant temperature). During this period, the zone of communication between the wells is expanded axially along the full well pair length and the steam chamber grows vertically up. The reservoir top may be a thick shale (overburden) or some lower permeability facies that cause the steam chamber to stop rising.

Reservoirs subjected to thermal and/or solvent-based hydrocarbon recovery techniques, such as for example SAGD, SAP or SDP, typically contain a significant volume of residual or stranded hydrocarbons, often in reservoir zones that are located adjacent to one or more production chambers (e.g., between, above and/or below). These zones containing a stranded pay of hydrocarbons may, for example, form based on how the steam chamber geometry evolves over the lifecycle of the thermal recovery operation. Examples of factors that may affect and ultimately define steam chamber geometry include well pad size (e.g., spacing between adjacent SAGD well pairs, well configuration within the reservoir, techniques employed during the thermal recovery operations, and permeability barriers (e.g., lower permeability facies, such as shale layers). These factors, among others, often lead to a configuration of steam chambers within the reservoir that is not uniform, with steam chambers having different sizes, shapes, and areas of localization. In some instances, individual steam chambers may have merged with one another to form a common chamber, often referred to as a common mobilized hydrocarbon zone.

There exists a need for technologies that may be used to efficiently recover stranded hydrocarbons from within subterranean reservoirs where significant expenditures have already been incurred to produce the primary hydrocarbon pay from the steam chambers.

SUMMARY

Hydrocarbon recovery operations involving thermal techniques (e.g., SAGD, CSS and SAP) typically generate a significant volume of stranded mobile hydrocarbons in reservoir zones adjacent to the primary production chambers. For example, a SAGD well may inject millions of barrels of cold-water equivalent steam over its lifetime. While much of this heat is recovered in the produced fluids, some of the heat remains in the reservoir. As a consequence, a significant amount of heated and mobile hydrocarbon pay remains trapped in the reservoir during and after thermal recovery operations.

In some embodiments, these stranded hydrocarbons are located in zones between the production chambers of adjacent thermal recovery operations. In such situations, the stranded hydrocarbons cannot flow to the existing producers for various reasons, including for example due to low drainage angles. Wedge wells and infill wells have been used in the industry to capture such 'bypassed' pay. These techniques focus on operating the wedge well or infill well in a manner to establish a hydraulic or fluid communication with the primary production chambers and producing hydrocarbons from the wedge well or infill well in aggregate with the adjacent thermal recovery (e.g., SAGD) wells.

The present disclosure recognizes that techniques employing wedge wells or infill wells in parallel with, and/or in a manner to generate a hydraulic or fluid communication with the production chambers of, thermal recovery operations may give rise to a number of problems or challenges relating to efficiency in hydrocarbon production. For example, it is asserted herein that these techniques can give rise to issues involving inter-well communication, steam breakthrough, and the 'stealing' of hydrocarbon production from the primary production chambers. As a consequence, although wedge wells and infill wells have the capability to improve the overall amount of hydrocarbon production from reservoirs, this typically comes at a detriment to the efficiency of primary production, as well as increases in resource usage (e.g., steam) and environmental impact (e.g., GHG emissions).

The present disclosure asserts that efficient recovery of stranded hydrocarbons can be realized by using a recovery well to produce mobilized hydrocarbons from a stranded pay zone at an end-of-life stage after a production threshold is achieved for the thermal recovery operations. While various alternative production thresholds for defining the term "end-of-life stage" are described herein, end-of-life may be a point of time when the thermal production operation has effectively been ceased, for example when the well pad is on blowdown. The term "end-of-life" may alternatively be used to describe a period initiated when adjacent steam chambers begin to merge or coalesce.

In an embodiment, the present disclosure relates to a method of producing hydrocarbons from a subterranean reservoir, the method comprising: conducting a thermal recovery operation from a well or a well pair, the thermal recovery operation forming a mobilized hydrocarbon zone; providing a recovery well near or within a stranded pay zone, the stranded pay zone at an edge of the mobilized hydrocarbon zone; at an end-of-life stage after a production threshold is achieved for the thermal recovery operation, commencing an end-of-life recovery of mobilized hydrocarbons from the stranded pay zone by way of the recovery well; and producing hydrocarbons from the recovery well. In an embodiment, the stranded pay zone is at a reservoir boundary. In an embodiment, the recovery well is placed into a channel edge.

In an embodiment, the present disclosure relates to a method of producing hydrocarbons from a subterranean reservoir, the method comprising: conducting a first thermal recovery operation from a first well or a first well pair, the first thermal recovery operation forming a first mobilized hydrocarbon zone; conducting a second thermal recovery operation from a second well or a second well pair, the second thermal recovery operation forming a second mobilized hydrocarbon zone; providing a recovery well near or within a stranded pay zone; at an end-of-life stage after a production threshold is achieved for the first thermal recovery operation, the second thermal recovery operation, or a combination thereof, commencing an end-of-life recovery of mobilized hydrocarbons from the stranded pay zone by way of the recovery well; and producing hydrocarbons from the recovery well.

In some aspects, at least a portion of the stranded pay zone is located between the first mobilized hydrocarbon zone and the second mobilized hydrocarbon zone.

Thus, in some embodiments, the present disclosure relates to a method of producing hydrocarbons from a subterranean reservoir, the method comprising: conducting a first thermal recovery operation from a first well or a first well pair, the first thermal recovery operation forming a first mobilized hydrocarbon zone; conducting a second thermal recovery operation from a second well or a second well pair, the second thermal recovery operation forming a second mobilized hydrocarbon zone; continuing the first thermal recovery operation and the second thermal recovery operation to form a region of thermal communication between the first mobilized hydrocarbon zone and second mobilized hydrocarbon zone; providing a recovery well near or within a stranded pay zone, at least a portion of the stranded pay zone being located between the first mobilized hydrocarbon zone and the second mobilized hydrocarbon zone; at an end-of-life stage after a production threshold is achieved for the first thermal recovery operation, the second thermal recovery operation, or a combination thereof, commencing an end-of-life recovery of mobilized hydrocarbons from the stranded pay zone by way of the recovery well; and producing hydrocarbons from the recovery well. In some such embodiments, the production threshold is the forming of the region of thermal communication between the first mobilized hydrocarbon zone and second mobilized hydrocarbon zone.

In some embodiments, the stranded pay zone may be a bypassed region located between and below a common mobilized hydrocarbon zone that is formed upon merger of the first and second mobilized hydrocarbon zones. In some embodiments, the stranded pay zone may be within the region of thermal communication and separate the first and second mobilized hydrocarbon zones.

Irrespective of the location of the stranded pay zone, recovery of mobilized hydrocarbons from the stranded pay zone by way of the recovery well does not commence until the end-of-life stage of the thermal recovery operations. By this time, the stranded pay zone has been heated by prolonged thermal input provided during the primary recovery operations. As disclosed herein, at this end-of-life stage, the stranded hydrocarbons are capable of being produced at minimal or zero incremental SOR by utilizing latent heat energy that would otherwise be wasted.

Expanding on these concepts of recovering mobilized hydrocarbons from a stranded pay zone located between first and second thermal recovery operations, the present disclosure further asserts that similar advantages in efficiency can be realized for stranded hydrocarbons in a pay zone located above or below the thermal recovery operation, i.e., an upper pay zone or a lower pay zone. In an embodiment, the upper or lower pay zone may be within the same geological formation as the thermal recovery operation (e.g., same stratum of sand or sandstone). In an embodiment, the upper or lower pay zone may be external to the zone of the thermal recovery operation (e.g., separated by a permeability barrier and/or in a different stratum of the subterranean reservoir). At an end-of-life stage, mobilized hydrocarbons stranded in these pay zones are also capable of being recovered at minimal or zero incremental SOR.

In an embodiment, the present disclosure thus relates to a method of producing hydrocarbons from a subterranean reservoir, the method comprising: conducting a thermal recovery operation to recover mobilized hydrocarbons from a lower pay zone, the thermal recovery operation passively heating a stranded hydrocarbon pay in an upper stranded pay zone; providing a recovery well near or within the upper stranded pay zone; at an end-of-life stage after a production threshold is achieved for the thermal recovery operation from the lower pay zone, commencing an end-of-life recovery of mobilized hydrocarbons from the upper stranded pay zone by way of the recovery well; and producing hydrocarbons from the recovery well.

In another embodiment, the present disclosure thus relates to a method of producing hydrocarbons from a subterranean reservoir, the method comprising: conducting a thermal recovery operation to recover mobilized hydrocarbons from an upper pay zone, the thermal recovery operation passively heating a stranded hydrocarbon pay in a lower stranded pay zone; providing a recovery well near or within the lower stranded pay zone; at an end-of-life stage after a production threshold is achieved for the thermal recovery operation from the upper pay zone, commencing an end-of-life recovery of mobilized hydrocarbons from the lower stranded pay zone by way of the recovery well; and producing hydrocarbons from the recovery well.

In some embodiments, the upper stranded pay zone or the lower stranded pay zone may be segregated from the primary hydrocarbon production zones (lower or upper, respectively) by a barrier of impermeability. Although the barrier of impermeability largely prevents fluid communication, thermal communication still occurs such that the upper or lower stranded pay zones may still be heated by the prolonged thermal input provided during the primary recovery operations.

A number of advantages can be realized by the end-of-life hydrocarbon recovery techniques disclosed herein. For example, embodiments of the methods disclosed can increase efficiency of hydrocarbon production, such as by utilizing latent heat energy that would otherwise be wasted to capture hydrocarbon pay that would otherwise be stranded. The improved efficiency may manifest, for example, in improved cumulative SOR, increased total production, and lower greenhouse gas (GHG) emissions per unit of production. Indeed, the methods disclosed herein are capable of unlocking millions of barrels of near-zero GHG intensity hydrocarbon pay that would be otherwise stranded or would consume significant resources to produce, thus providing cleaner oil and gas production. Indeed, some embodiments of the methods disclosed herein involve zero incremental SOR since producing the stranded hydrocarbon pay is without additional input of steam.

In some embodiments, the methods disclosed herein may also lower costs through: (i) wider-than-conventional well spacing; (ii) repurposing of existing surface facilities; and (iii) minimizing additional drilling requirements. By more efficiently capturing hydrocarbons in stranded pay zones between SAGD well pairs, it is expected that the distance between adjacent well pairs can be extended, for example from a conventional width of about 100 m to a wider distance of 120 m or more. Also, embodiments of the methods disclosed herein represent a brownfield technology in the repurposing of existing surface facilities and redevelopment of existing wells.

The present disclosure is based on field studies and simulation work, which indicate that the stranded hydrocarbon pay can be produced economically with minimal to no incremental steam injection costs, and the ideal time to operate the recovery well is in the end-of-life stage after the parent producer stops production (e.g., during blowdown). Too early and there will be significant losses in efficiency and other challenges associated with inter-well communication. Too late and there will also be losses in efficiency and in production amounts.

Absent having conducted the extensive field studies and simulation work to identify the noted problems and challenges, it would be counter-intuitive to invest time, money, and effort on well redevelopment at an end-of-life stage of primary production (e.g., after primary production has ceased).

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

FIG. 2 is a graph depicting production rates and contributions of various different hydrocarbon recovery operations: (i) Parent, no wedge, (ii) Parent+Wedge, (iii) Wedge, and (iv) Parent contribution with Wedge turned on.

FIG. 9A shows the simulated recovery for the 2021 recovery well. FIG. 9B shows the simulated recovery for the 2022 recovery well. FIG. 9C shows the simulated recovery for the 2025 recovery well.

FIG. 13A shows simulated oil production rates at high (P10), mid (P50) and low (P90), with Swanson's mean shown as a dotted line. FIG. 13B is a graph showing the simulated steam injection rate during the end-of-life recovery, whereby no steam is injected and the pad is on blowdown.

DETAILED DESCRIPTION

The present disclosure relates to an end-of-life recovery of stranded hydrocarbons in a subterranean reservoir by way of a recovery well.

Hydrocarbon recovery operations involving thermal techniques (e.g., SAGD, CSS and SAP) often inject millions of barrels of cold-water equivalent steam over the lifetime of the recovery process. While much of this heat is recovered in the produced fluids, some of the heat remains in the reservoir after the primary recovery operation is complete. Additionally, during and after the thermal recovery process, typically spaced SAGD wells may have a significant amount of mobile hydrocarbon pay between producers. This mobile hydrocarbon pay cannot flow to the existing producers for various reasons, including for example due to low drainage angles.

Wedge wells and infill wells have been used in the industry to capture such 'bypassed' pay, for example by improving drainage between existing SAGD well pairs. These techniques focus on operating the wedge well or infill well in a manner to establish a hydraulic or fluid communication with the primary production chambers and producing hydrocarbons from the wedge well or infill well in aggregate with the adjacent thermal recovery (e.g., SAGD) wells.

Figure 1:
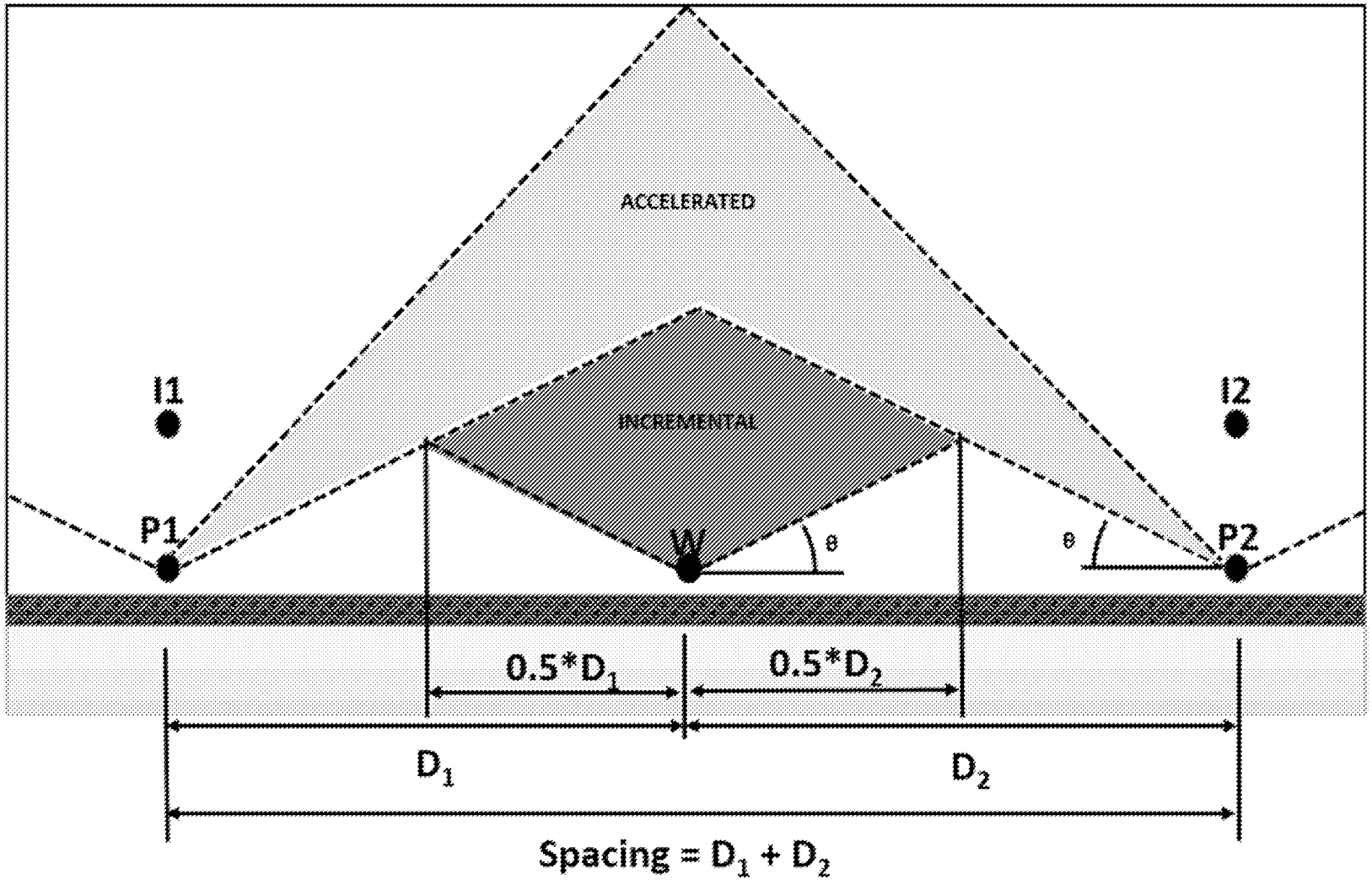
FIG. 1 is a schematic of adjacent SAGD injector-producer well pairs (I1/P1 and I2/P2), whereby production from a common mobilized hydrocarbon zone is accelerated based on hydraulic or fluid communication and aggregate operation with a wedge well or infill well in a zone of incremental production.
Figure 2:
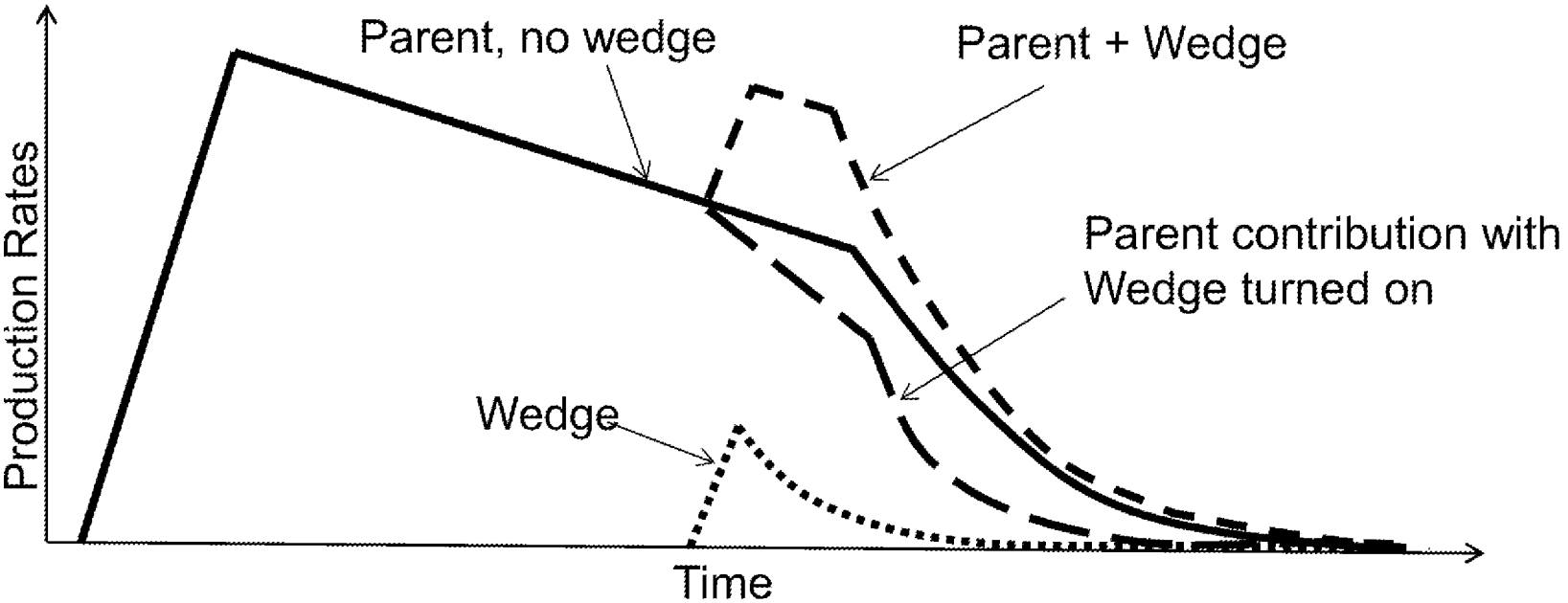

Based on extensive commercial activity, field studies and simulation work, it is asserted herein that such techniques may present problems and challenges with respect to efficiency of thermal recovery operations. This situation is illustrated in FIG. 1 and FIG. 2. A common configuration for a wedge well or infill well is shown in FIG. 1. Although parallel operation and hydraulic/fluid communication between the wedge well and primary production chambers accelerates hydrocarbon production from the primary production chambers, challenges can arise with respect to inter-well communication. For example, as shown in FIG. 2, while overall production increases with the use of a wedge well ("Parent+Wedge"), this can come at a detriment to production by the parent producers ("Parent contribution with Wedge turned on"). This is due, for example, to the wedge well 'stealing' production from the primary production chambers. Thus, efficiency of overall hydrocarbon production from the primary chambers may in fact decrease in view of the additional steam input requirements of the wedge well or infill well. Also, in certain conditions, hydraulic/fluid communication between the primary production chambers and the wedge well or infill well may limit hydrocarbon production due to early steam breakthrough to the wedge well or infill well. Thus, the incremental benefit to capturing the stranded hydrocarbons (FIG. 1; "Incremental") may be minimal for existing wedge well or infill well technologies. Although benefits in overall hydrocarbon production quantities are typically obtained, the efficiency in capturing the incremental benefit (stranded hydrocarbon pay) may not be optimal.

The present disclosure asserts that efficient recovery of stranded hydrocarbons can be realized by using a recovery well to produce mobilized hydrocarbons from a stranded pay zone at an end-of-life stage after a production threshold is achieved for the thermal recovery operations. Embodiments of the methods disclosed can increase efficiency of hydrocarbon production, such as by utilizing latent heat energy present in the reservoir at an end-of-life stage to capture mobilized hydrocarbons in a stranded pay zone. Indeed, reservoir simulations confirm that the stranded hydrocarbon pay can be extracted economically, in some embodiments with no incremental surface or steam injection costs.

A number of advantages can be realized by the end-of-life hydrocarbon recovery techniques disclosed herein. For example, embodiments of the methods disclosed herein provide one or more of the following benefits: (i) improved quantity of hydrocarbon recovery from subterranean reservoirs; (ii) ability to space the thermal recovery wells (e.g., SAGD well pairs) at a further distance apart (e.g., >100 m), leading to improved capital efficiency and lowering costs; (iii) avoidance of inter-well communication, thereby preventing steam breakthrough and 'stealing' of primary production; (iv) repurposing of surface facilities; (v) redevelopment of well infrastructure, including the use of abandoned producer wells of the thermal recovery operations; (vi) no additional steam to provide incremental production benefit from capturing the stranded hydrocarbon pay; (vii) 100% incremental production that would not be produced otherwise; and (viii) lower greenhouse gas (GHG) emissions per unit of production.

The end-of-life recovery methods disclosed herein are capable of yielding hydrocarbon pay that remains stranded in the reservoir after production thresholds for the thermal recovery operations are met. The stranded resource cannot be accessed with parent producers due to various factors, including for example low drainage angles, location of the stranded pay zone within the reservoir, and/or barriers of impermeability. The methods disclosed herein allow for the production of the stranded hydrocarbon pay at zero or near zero SOR. Furthermore, embodiments of the technology are scalable, can be implemented within the existing infrastructure (e.g., pads, wells, pipelines, etc.) and would require a lower capitol investment than a greenfield operation.

In some embodiments, the present disclosure relates to a method of producing hydrocarbons from a subterranean reservoir, the method comprising: conducting a first thermal recovery operation from a first well or a first well pair, the first thermal recovery operation forming a first mobilized hydrocarbon zone; conducting a second thermal recovery operation from a second well or a second well pair, the second thermal recovery operation forming a second mobilized hydrocarbon zone; providing a recovery well near or within a stranded pay zone; at an end-of-life stage after a production threshold is achieved for the first thermal recovery operation, the second thermal recovery operation, or a combination thereof, commencing an end-of-life recovery of mobilized hydrocarbons from the stranded pay zone by way of the recovery well; and producing hydrocarbons from the recovery well.

As used herein, the term "hydrocarbon" includes, but is not limited to, viscous hydrocarbons, such as bitumen or heavy oil. Some sources define "heavy oil" as a petroleum that has a mass density of greater than about 900 $kg/m^3$. Bitumen is sometimes described as that portion of petroleum that exists in the semi-solid or solid phase in natural deposits, with a mass density greater than about 1000 $kg/m^3$ and a viscosity greater than 10,000 centipoise (cP; or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. The reference herein to hydrocarbons includes the continuum of such substances. In some embodiments, the hydrocarbons for recovery by the methods disclosed herein are bitumen.

A "subterranean reservoir" is a subsurface formation containing one or more natural accumulations of moveable hydrocarbons. An "oil sand" or "tar sand" reservoir is generally comprised of strata of sand or sandstone containing hydrocarbons. A "zone" in a reservoir is an arbitrarily defined volume of the reservoir, typically characterised by some distinctive property. For example, a "pay zone" is a region of the reservoir containing a hydrocarbon pay. A "mobilized hydrocarbon zone" is a region within the reservoir whereby hydrocarbon pay is or has become mobilized, such as by a thermal recovery operation. In some embodiments, the mobilized hydrocarbon zone is a steam chamber or production chamber formed by the thermal recovery operation. As used herein, a "chamber" is a region that is in fluid communication with a particular well or well pair.

As used herein, the expression "stranded pay zone" describes a region of the subterranean reservoir in which a mobilized hydrocarbon pay is located but cannot operationally be recovered by way of the thermal recovery operations. Hydrocarbons in the stranded pay zone have been heated by nearby or adjacent thermal recovery operations and have become mobilized to at least some extent.

In some embodiments, the stranded pay zone has an average temperature of at least about 60° C. In some embodiments, the stranded pay zone has an average temperature of between about 60° C. and about 220° C., more particularly between about 60° C. and about 160° C. In some embodiments, the stranded pay zone has an average temperature of at least about 100° C. In some embodiments, the stranded pay zone has an average temperature of about 60° C., about 65° C., about 70° C., about 75° C., about 80° C., about 85° C., about 90° C., about 95° C., about 100° C., about 105° C., about 110° C., about 115° C., about 120° C., about 125° C., about 130° C., about 135° C., about 140° C., about 145° C., about 150° C., about 155° C., or about 160° C.

In some embodiments, the stranded pay zone has a residual oil saturation of at least about 60%. In some embodiments, the stranded pay zone has a residual oil saturation of between about 60% and about 95%. In some embodiments, the stranded pay zone has a residual oil saturation of about 60%, about 65%, about 70%, about 75%, about 80%, about 85%, about 90%, about 95%. In some embodiments, the stranded pay zone has a residual oil saturation of at least about 80%.

As used herein, a "thermal recovery operation" or "thermal recovery" refers to enhanced hydrocarbon recovery techniques that involve delivering thermal energy to a hydrocarbon resource, for example to a heavy oil and/or bitumen reservoir. There are a significant number of thermal recovery techniques, including without limitation steam-assisted gravity drainage (SAGD), cyclic steam stimulation (CSS), in situ combustion, hot water flooding, steam flooding, electrical heating, and solvent-aided processes (SAP). In general, thermal energy is provided to reduce the viscosity of the hydrocarbons to facilitate production. The addition of heat may also have geophysical effects within the reservoir, for example causing the expansion of reservoir fluids, which may in turn lead to increases in pore pressures. In some embodiments of the methods disclosed herein, the thermal recovery operation is SAGD. The thermal recovery operations described herein, occurring before the end-of-life stage begins, may be referred to as "primary production" or a "primary production phase."

In some embodiments of the methods disclosed herein, the thermal recovery operation is performed from a well or a well pair. As used herein, the term "well" is intended to encompass a single wellbore from the surface which may include one or more wells therein and/or branches below the surface. For example, the wellbore may include a single well and in various embodiments the single well may perform different functions depending on the type and stage of the recovery operation (e.g., steam injection, gas injection, production, temperature monitoring, etc.). In other embodiments, the wellbore may include more than one well therein whereby the individual wells may be responsible for different functions. As used herein, the term "well pair" is intended to encompass a pair of wells, each well being a separate wellbore from the surface. For example, a typical well pair in a SAGD process will include an injection well and a production well (e.g., an injector-producer well pair).

Generally, in the methods disclosed herein, one or more thermal recovery operations are performed to form mobilized hydrocarbon zones (production chambers) from which mobilized hydrocarbons are recovered during the thermal recovery operations (e.g., SAGD). During the thermal recovery operation, regions near or adjacent (e.g., between, above and/or below) the production chambers become heated. Heating of these regions over the prolonged process of the thermal recovery results in nearby pay zones having mobilized hydrocarbons stranded therein, referred to herein as stranded pay zones. The present disclosure asserts that the stranded hydrocarbon pay is efficiently recovered at an end-of-life stage of the thermal recovery operation.

The methods disclosed herein involve use of a recovery well near or within the stranded pay zone for capturing mobilized hydrocarbons from the stranded pay zone at an end-of-life stage after a production threshold is achieved for the thermal recovery operation. The commencement of the end-of-life stage may be determined by any of a number of production thresholds, alone or in combination, such as for example coalescence or merger of adjacent steam chambers.

In some embodiments, the production threshold is a permanent cessation of steam injection for a thermal recovery operation, for example one or both of the first thermal recovery operation and the second thermal recovery operation. In some embodiments, the production threshold is a permanent cessation of steam for each and all thermal recovery operations adjacent to the stranded pay zone (e.g., both the first thermal recovery operation and the second thermal recovery operation). In some embodiments, the production threshold is a permanent cessation of steam at the well pad associated with the thermal recovery operations. By permanent cessation, it is meant that steam injection is permanently terminated in respect of the thermal recovery operations. An injection well of the well or well pair may remain or be put on gas injection (without steam) or may be shut-in. In some embodiments, the injection well is permanently shut-in after cessation of steam injection.

In some embodiments, the production threshold is defined by an average drainage angle for mobilized hydrocarbons in one or both of the first mobilized hydrocarbon zone and second mobilized hydrocarbon zone (e.g., primary production chambers). The average drainage angle is indicative of the ability of hydrocarbons to flow to the producer well of the thermal recovery operation. When the average drainage angle reaches a certain value, the economic viability of recovery of hydrocarbons from the thermal recovery operations is reduced, thus providing a threshold for ceasing hydrocarbon production via the thermal recovery operations. In some embodiments, the average drainage angle for ceasing thermal recovery operations is between zero and about 10 degrees. In some embodiments, the average drainage angle is about 1°, about 2°, about 3°, about 4°, about 5°, about 6°, about 7°, about 8°, about 9°, or about 10°. In an embodiment, the average drainage angle is 7° or less. The respective angle will vary with interwell spacing.

In some embodiments, the production threshold is defined by a hydrocarbon production rate for the thermal recovery operation (e.g., either the first thermal recovery operation or the second thermal recovery operation). The hydrocarbon production rate is indicative of economic viability of recovery of hydrocarbons from the thermal recovery operations, thus providing a threshold for ceasing hydrocarbon production via the thermal recovery operations. In some embodiments, the hydrocarbon production rate for ceasing thermal recovery operations is between zero and about 25 $m^3$/day. In some embodiments, the hydrocarbon production rate is about 1 $m^3$/day, about 2.5 $m^3$/day, about 5 $m^3$/day, about 7.5 $m^3$/day, about 10 $m^3$/day, about 12.5 $m^3$/day, about 15 $m^3$/day, about 17.5 $m^3$/day, about 20 $m^3$/day, about 22.5 $m^3$/day, or about 25 $m^3$/day. In some embodiments, the hydrocarbon production is about 10 $m^3$/day or less. In some embodiments, the hydrocarbon production is about 5 $m^3$/day or less.

In some embodiments, the production threshold is defined by a gas/oil ratio (GOR) for produced hydrocarbons from the thermal recovery operation. In an embodiment, the GOR is at least 2, and more particularly at least 5. In an embodiment, the GOR is between about 2 and about 1000, more particularly between about 5 and about 700, and more particularly still between about 100 and about 700.

In some embodiments, the production threshold is defined by a residual oil saturation within the mobilized hydrocarbon zone (i.e., production chamber) of the thermal recovery operation. In an embodiment, the residual oil saturation is less than 80%. In an embodiment, the residual oil saturation is between about 1% and about 80%. In an embodiment, the residual oil saturation is less than 70%, less then 60%, less than 50%, less than 40%, less than 30%, less than 20%, less than 10%, or even less. In an embodiment, the residual oil saturation is between about 20% and about 70%. The residual oil saturation may be dependent on steam sweep efficiency and/or conformance. If the steam sweep efficiency is high and there is good conformance throughout the mobilized hydrocarbon zone, the production threshold as defined by residual oil saturation will be lower, such as for example 20% or less. However, if steam sweep efficiency is low and there is poor conformance, the production threshold as defined by residual oil saturation will be higher, such as for example between about 50% and about 80%.

In some embodiments, the production threshold is defined by a total recovery factor of hydrocarbons from the thermal recovery operation(s). By "total recovery factor," it is meant the operational or theoretical maximum recovery of hydrocarbons from the reservoir in relation to the total predicted quantity of hydrocarbons in the reservoir. Determining the appropriate production threshold for end-of-life recovery may depend, for example, on the predicted Producible Oil In Place (POIP). Generally, based on POIP, the total recovery factor is between 60-70% of the actual predicted quantity of hydrocarbons in the reservoir. In an embodiment, the production threshold for end-of-life recovery based on total recovery factor is at least 35%. In an embodiment, the production threshold for end-of-life recovery is about 35%, about 40%, about 45%, about 50%, about 55%, about 60%, about 65%, about 70%, or higher. In situations where the POIP is lower, end-of-life recovery may commence at a lower threshold (e.g., total recovery factor of between 35-50%). In situations where the POIP is higher, end-of-life recovery may commence at a higher threshold (e.g., total recovery factor of greater than 50%).

In some embodiments, the production threshold is an operational constraint. For example, the production threshold may be a "no-flow" situation where the operation of the pumps is limited by elevated gas levels in the pumps, such that only gas is cycling in the pumps and hydrocarbons are not being produced. The pumps are effectively in a no-flow state because so much gas is cycling through, and moves more aggressively than the oil, resulting in little to no hydrocarbon production. In such circumstances, commencement of end-of-life recovery may be advantageous.

In some embodiments, the production threshold used to identify the end-of-life stage is any single one of the production thresholds described herein. In other embodiments, the production threshold used to identify the end-of-life stage is any combination of the production thresholds described herein. The production thresholds are indicative of when hydrocarbon production from the thermal recovery operation has effectively ceased, and end-of-life recovery from the recovery well can commence without detriment to the thermal recovery operations and by capitalizing on latent heat energy within the reservoir as a result of the prolonged thermal recovery operations.

In some embodiments, the end-of-life stage does not commence until after hydrocarbon production from the thermal recovery operation has permanently ceased. By this, it is meant that production from the primary production chambers (i.e., the first and/or second mobilized zones) is no longer occurring and will not be re-initiated. In some embodiments, the production has permanently ceased for each and all thermal recovery operations adjacent to the stranded pay zone (e.g., both the first thermal recovery operation and the second thermal recovery operation). In some embodiments, the production has permanently ceased for all thermal recovery operations from the well pad associated with the first thermal recovery operation and the second thermal recovery operation.

In some embodiments, the end-of-life stage does not commence until after blowdown operations have begun at the wells associated with the thermal recovery operations. In some embodiments, the entire well pad associated with the thermal recovery operations is on blowdown. During this timeframe, and after the production well of the thermal recovery operation stops producing, may represent an optimal time to drill and commence end-of-life recovery from the recovery well. At this stage, there can be no inter-well interference or 'stealing' of production from the thermal recovery operation. Moreover, at the commencement of blowdown the hydrocarbons in the stranded pay zone will have been subjected to prolonged heating from the thermal recovery operations and will be suitably mobilized for capture from the recovery well.

In some embodiments, the end-of-life stage begins during the blowdown operation, for example at about the same time the blowdown operation begins or some time thereafter while blowdown is still being performed. In some embodiments, the end-of-life stage begins after completion of the blowdown operation.

There is an optimal window of time during which the end-of-life recovery should be performed before the end-of-life recovery operations decrease in efficiency and economic value. This optimal window of time is dependent on a number of factors, including without limitation the temperature of the stranded pay, geologic features of the reservoir, and end-of-life hydrocarbon recovery production rate. In some embodiments, the optimal timeframe for end-of-life recovery is from commencement of the end-of-life stage as defined by any one or more of the production thresholds described herein and up until five years thereafter. In some embodiments, the optimal timeframe for end-of-life recovery is from commencement of the end-of-life stage and up until three years thereafter. In some embodiments, the optimal timeframe for end-of-life recovery is from commencement of the end-of-life stage and up until two years thereafter.

More particularly, in some embodiments, the optimal timeframe for end-of-life recovery is from commencement of blowdown and up until ten years thereafter, more particularly five years thereafter. In some embodiments, the optimal timeframe for end-of-life recovery is from commencement of blowdown and up until three years thereafter. In some embodiments, the optimal timeframe for end-of-life recovery is from commencement of blowdown and up until two years thereafter.

In the methods disclosed herein, the end-of-life recovery from the recovery well is not by way of a thermal recovery operation. Rather, the end-of-life recovery relies substantially on enthalpy and/or latent energy already present with the stranded pay zone at the end-of-life stage. The end-of-life recovery uses heat present in the reservoir at the end-of-life stage to produce mobilized hydrocarbons from the reservoir. In some embodiments, the latent heat in the reservoir is sufficient and the end-of-life recovery is without any input of steam, gas, water, or any combination thereof during the end-of-life stage. In particular embodiments, the end-of-life recovery is without any input of steam during the end-of-life stage. In some embodiments, gas may be injected via the recovery well to maintain or generate pressure in the stranded pay zone to produce the mobilized hydrocarbons to the surface. Any suitable gas may be used. In some embodiments the gas is a non-condensable gas (NCG), such as for example and without limitation, methane. In some embodiments, a solvent may be injected via the recovery well to aid in recovery of the mobilized hydrocarbons in the stranded pay zone. In some embodiments, the recovery well is equipped with an electric downhole pump (ESP), a rod pump, an eccentric cavity pump, or a gas lift feature (artificial lift) to aid in recovery of the mobilized hydrocarbons in the stranded pay zone.

In some embodiments, a small quantity of steam may be injected via the recovery well to maintain heat within the stranded pay zone. However, if steam is used during the end-of-life recovery, it is in an amount that is insufficient to establish a hydraulic communication with either the first mobilized hydrocarbon zone or the second mobilized hydrocarbon zone (i.e., the primary production chambers). An aspect of the methods of the present disclosure is to avoid such communication with the primary production chambers, for example to prevent negative consequences associated with inter-well communication (e.g., gas or steam breakthrough from the primary production chambers). In some embodiments, if steam is used during the end-of-life recovery, it is in an amount that is insufficient to cause conductive heating of a region within either the first mobilized hydrocarbon zone or the second mobilized hydrocarbon zone.

An advantageous aspect of the methods of the present disclosure, for example as evidenced by the simulation data herein, is that end-of-life recovery of mobilized hydrocarbons from stranded pay zones can be produced from the recovery well at zero or near zero SOR. In some embodiments, the producing of hydrocarbons from the recovery well is at a cumulative injected steam-to-oil ratio (iSOR) of 2 or less. In some embodiments, the producing of hydrocarbons from the recovery well is at a cumulative iSOR of zero.

In the methods disclosed herein, the recovery well is provided within the subterranean reservoir at a location that is near and/or within the stranded pay zone. In some embodiments, at least a portion of the recovery well is located within the stranded pay zone. Positioning of the recovery well can be based on a number of factors, including without limitation reservoir geology, temperature measurements, porosity measurements, residual oil saturation levels, barriers of impermeability, existing surface structures, and existing subterranean infrastructure (e.g., wells). In some embodiments, the recovery well is drilled from an existing surface location into a stranded pay zone. In some embodiments, the recovery well is drilled from an existing producer well that has reached end-of-life. For example, a horizontal portion of a producer well may be sidetracked. In such embodiments, the horizontal portion beyond the recovery well sidetrack may be abandoned and the recovery well operated in its place. In some embodiments, the sidetracked recover well may be deepened below the existing producer wells if the geological features of the reservoir allow for such. Deepening may allow for increased productivity and higher GHG savings.

In some embodiments, the recovery well is drilled prior to the production threshold, but not operated until after the production threshold(s) is reached and the thermal recovery operation is at the end-of-life stage. More preferably, in some embodiments, the recovery well is not drilled until after the production threshold(s) is reached and the thermal recovery operation is at the end-of-life.

Exemplary positioning and timing of drilling the recovery well will be more apparent having regard to the descriptions that follow relating to various embodiments of the methods disclosed herein, whereby the stranded pay zone is located between two mobilized hydrocarbon zones; above one or more mobilized hydrocarbon zones; or below one or more mobilized hydrocarbon zones. In some embodiments, a single recovery well may be provided to produce the mobilized hydrocarbons from a particular stranded pay zone during end-of-life recovery. In some embodiments, two or more recovery wells may be provided to produce the mobilized hydrocarbons from a particular stranded pay zone during end-of-life recovery. If more than one recovery well is employed, typically each recovery well will have a different configuration (e.g., depth, orientation to primary producers, length, etc.) and will capture stranded hydrocarbon pay from a different region of the stranded pay zone.

In select embodiments of the methods disclosed herein, the stranded pay zone is located within the subterranean reservoir such that at least a portion of the stranded pay zone is between mobilized hydrocarbon zones of thermal recovery operations. For example, the stranded pay zone may be between two mobilized hydrocarbon zones of adjacent thermal recovery operations. The thermal recovery operations may be SAGD, such that the stranded pay zone is between two production chambers of adjacent SAGD well pairs.

Thus, in select embodiments, the present disclosure relates to a method of producing hydrocarbons from a subterranean reservoir, the method comprising: conducting a first thermal recovery operation from a first well or a first well pair, the first thermal recovery operation forming a first mobilized hydrocarbon zone; conducting a second thermal recovery operation from a second well or a second well pair, the second thermal recovery operation forming a second mobilized hydrocarbon zone; continuing the first thermal recovery operation and the second thermal recovery operation to form a region of thermal communication between the first mobilized hydrocarbon zone and second mobilized hydrocarbon zone; providing a recovery well near or within a stranded pay zone, at least a portion of the stranded pay zone being located between the first mobilized hydrocarbon zone and the second mobilized hydrocarbon zone; at an end-of-life stage after a production threshold is achieved for the first thermal recovery operation, the second thermal recovery operation, or a combination thereof, commencing an end-of-life recovery of mobilized hydrocarbons from the stranded pay zone by way of the recovery well; and producing hydrocarbons from the recovery well. In some such embodiments, the production threshold defining commencement of the end-of-life stage is merger or coalescence of adjacent steam chambers.

If the two adjacent mobilized hydrocarbon zones have merged to form a common mobilized hydrocarbon zone, then the stranded pay zone may be a bypassed region located below the common mobilized hydrocarbon zone. As will be understood, given the typical configuration of SAGD production chambers (e.g., lateral, and upward progression), the stranded pay zone may be both between and below the common mobilized hydrocarbon zone. As used herein, "common mobilized hydrocarbon zone" refers to a merger between two previously independent and isolated mobilized hydrocarbon zones, whereby upon merger there is fluid communication between the zones.

Alternatively, the stranded pay zone may separate the adjacent (e.g., first and second) mobilized hydrocarbon zones. In such embodiments, a region of thermal communication may form between the production chambers of the thermal recovery operations, but the thermal communication does not evolve to the extent of there being fluid communication between the production chambers. Thus, a common mobilized hydrocarbon zone is not formed. In such embodiments, the stranded pay zone may still be below laterally upward extending portion of adjacent mobilized hydrocarbon zones, but it continues to extend upwards and separates the adjacent mobilized hydrocarbon zones. This may represent an advantageous aspect of the methods herein since the ability to recover hydrocarbon pay stranded between the mobilized zone may allow for increased spacing between adjacent thermal recovery operations (e.g., adjacent SAGD well pairs).

To recover the mobilized hydrocarbons from a stranded pay zone located between two mobilized hydrocarbon zones, the recovery well may be of any suitable configuration. In some embodiments, the recovery well is generally aligned on a vertical plane with a substantially horizontal portion of one or both of the first well or a production well of the first well pair and the second well or a production well of the second well pair. Thus, the recovery well may be positioned at about the same vertical depth as a production well of the thermal recovery process. In other embodiments, the recovery well may be placed vertically above or vertically below a production well of the thermal recovery process. Positioning the recovery well vertically below the production well may be advantageous in improving recovery of stranded hydrocarbon pay. In an embodiment, the recovery well is vertically spaced below the substantially horizontal portion of the production well by at least about 1 m, more particularly between about 1 m and about 10 m.

The recovery well may be of any number of different configurations or combinations thereof. In some embodiments, the recovery well is substantially horizontal, slanted in an upward direction, slanted in a downward direction, or any combination thereof over any particular length of the recovery well. In a particular embodiment, the recovery well is a sidetrack of a production well of the thermal recovery process and the recovery well is slanted downwards or is substantially horizontal but deepened below the existing production well. In other embodiments, the recovery well is substantially horizontal and on plane with the existing production well of the thermal recovery operation. In some embodiments, the recovery well runs generally parallel with, and about midway between, two production wells of adjacent thermal recovery operations.

Figure 3:
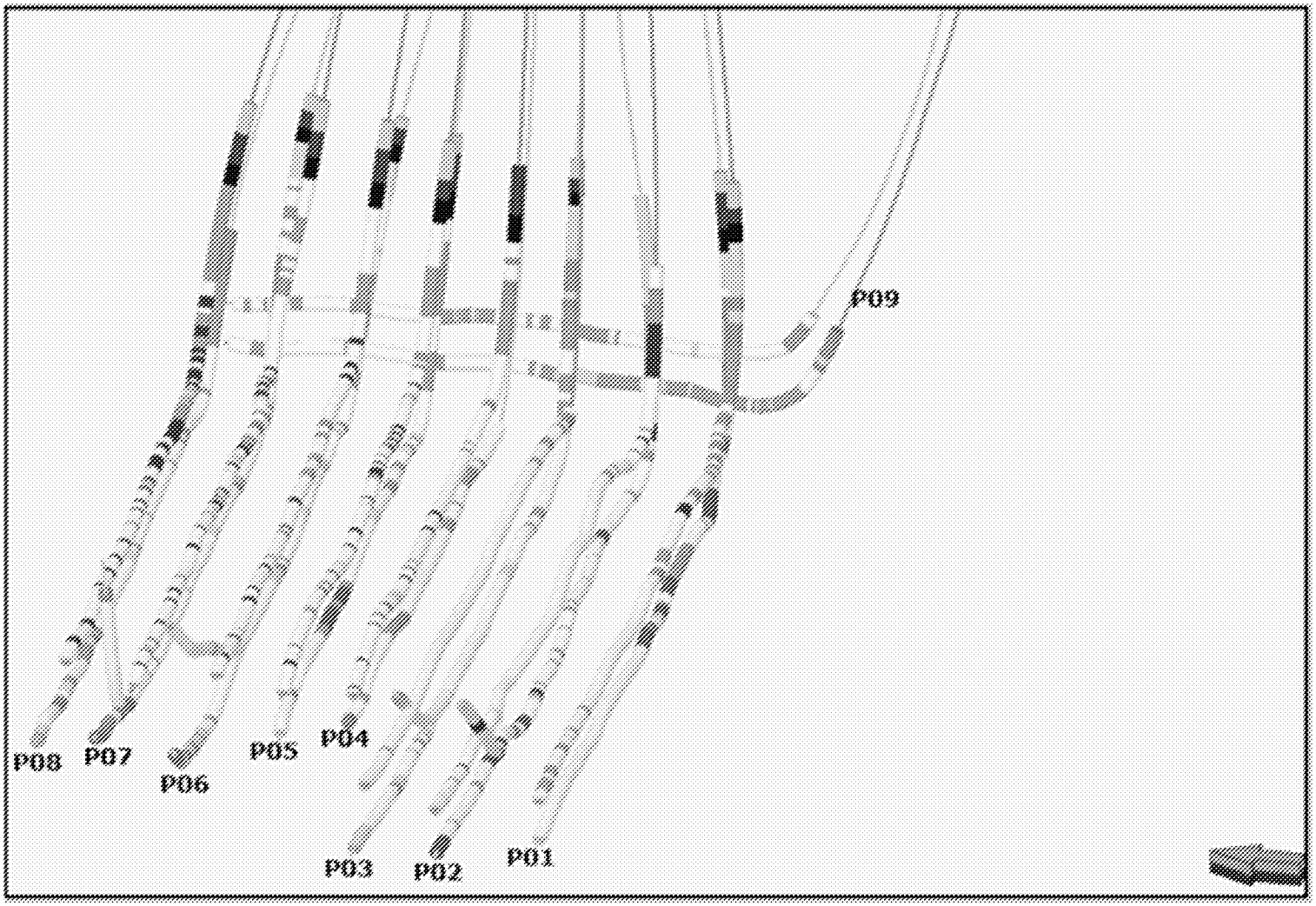
FIG. 3 is a schematic of the injector and producer well pairs (P01-P08) at a particular well pad used in the simulations herein.
Figure 4:
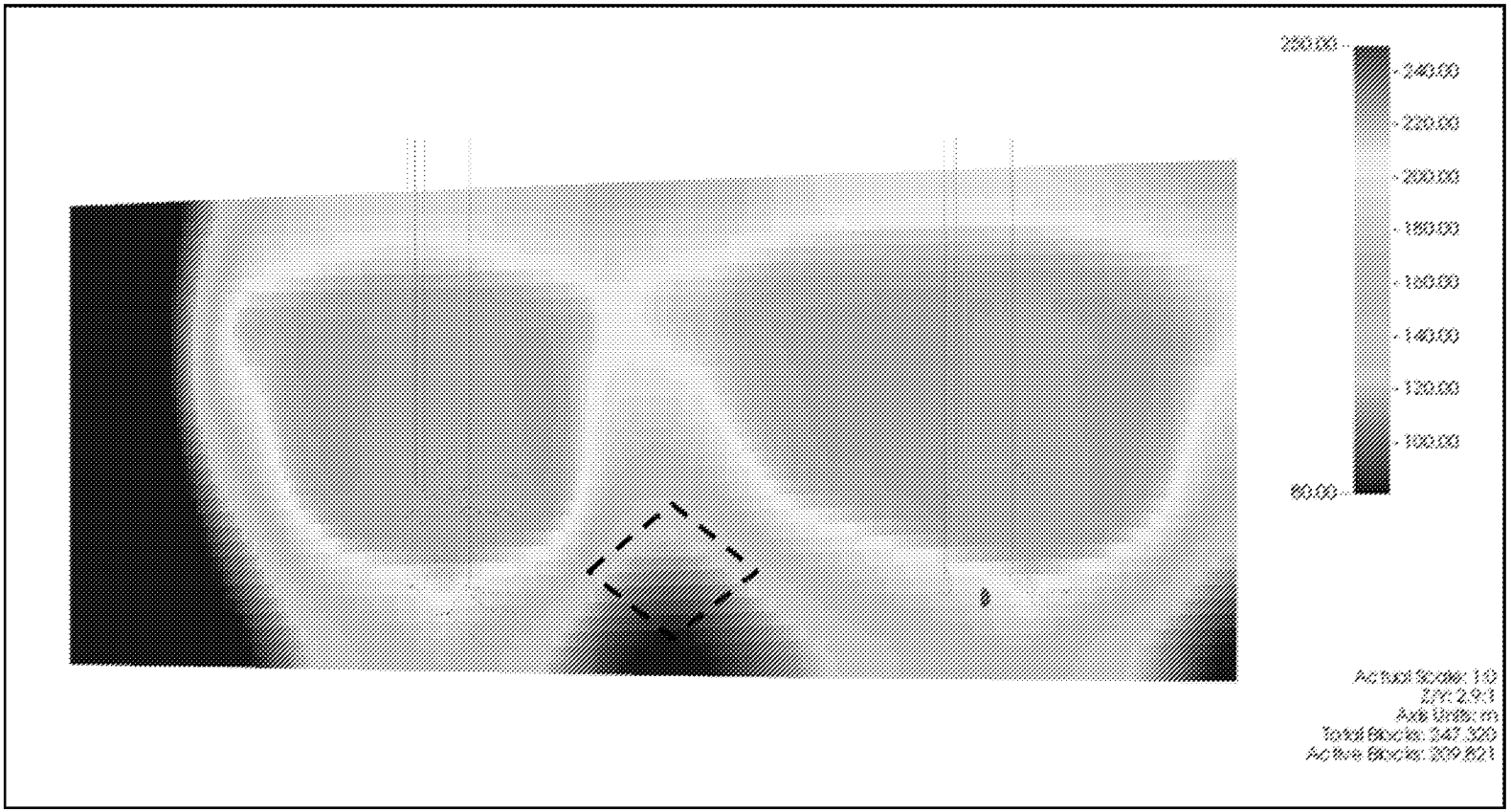
FIG. 4 is a simulated temperature profile of the area between two well pairs (P02 and P03) of FIG. 3. The average temperature within the hatched box is between about 60-200° C.
Figure 5:
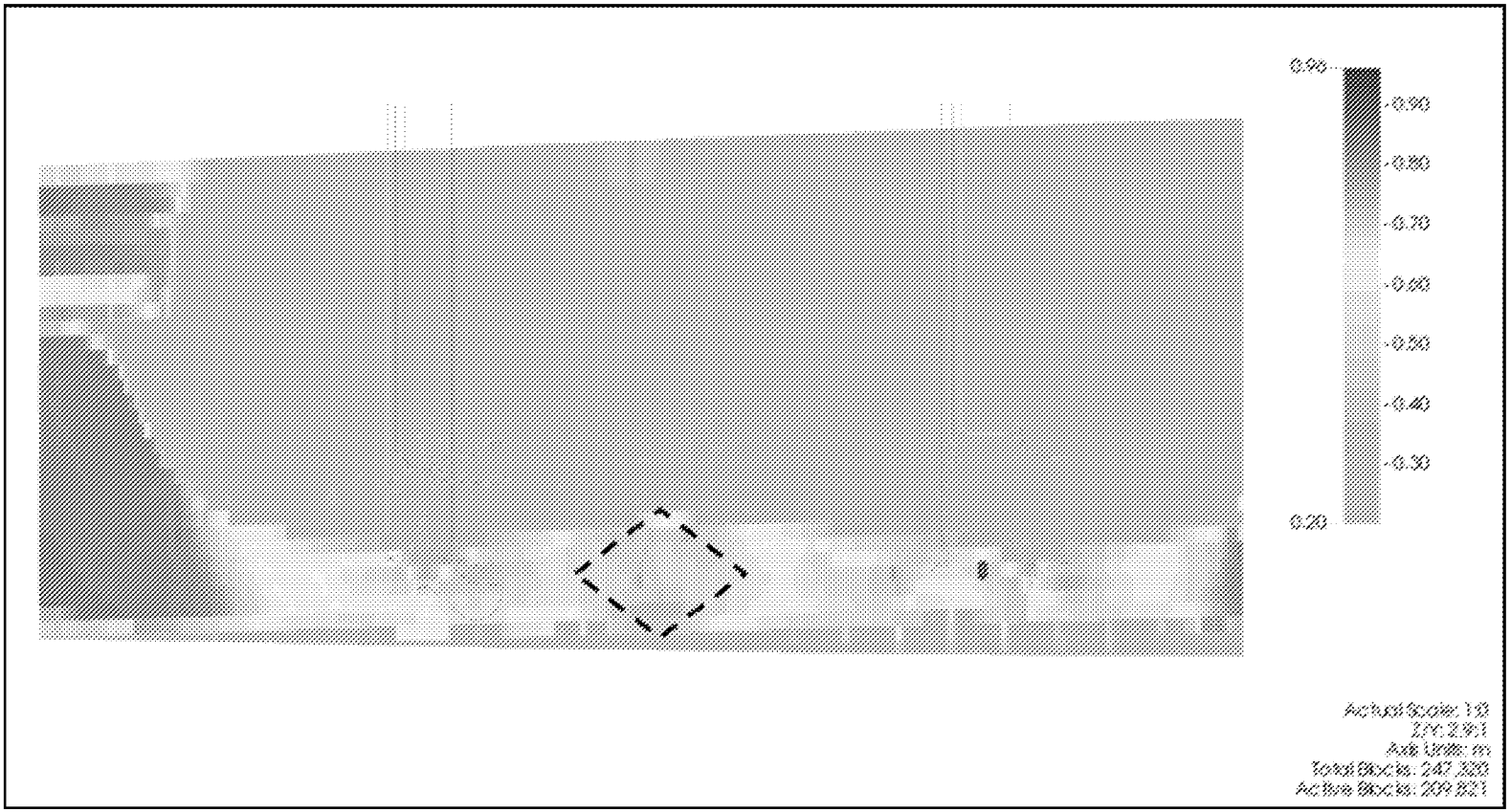
FIG. 5 is a simulated profile of the average oil saturation of the same area as shown in FIG. 4, depicting about 3-4 m of heated hydrocarbon pay at between approximately 68-78% average oil saturation within the hatched box.

In accordance with various aspects of the disclosure, detailed computational simulations of end-of-life recovery of mobilized hydrocarbons in stranded pay zones between the production chambers of first and second thermal recovery operations may be carried out. An exemplary simulation was prepared based on the operational history of thermal recovery operations at a particular well pad. This well pad includes 8 SAGD well pairs (P01-P08) with approximately 100 m spacing between the well pairs, 900-1300 m well lengths, and no prior redevelopments. The reservoir includes 1 well pair off a different well pad surface (P09). A schematic of the injector and producer well pairs is shown in FIG. 3 and a simulated temperature profile of the area between two pairs (P02 and P03) is shown in FIG. 4. In the indicated area between the two well pairs (hatched box), the average temperature is between about 60-200° C. A simulated profile of the average oil saturation of the same area is shown in FIG. 5, depicting about 3-4 m of heated hydrocarbon pay at between approximately 68-78% average oil saturation.

Figure 6:
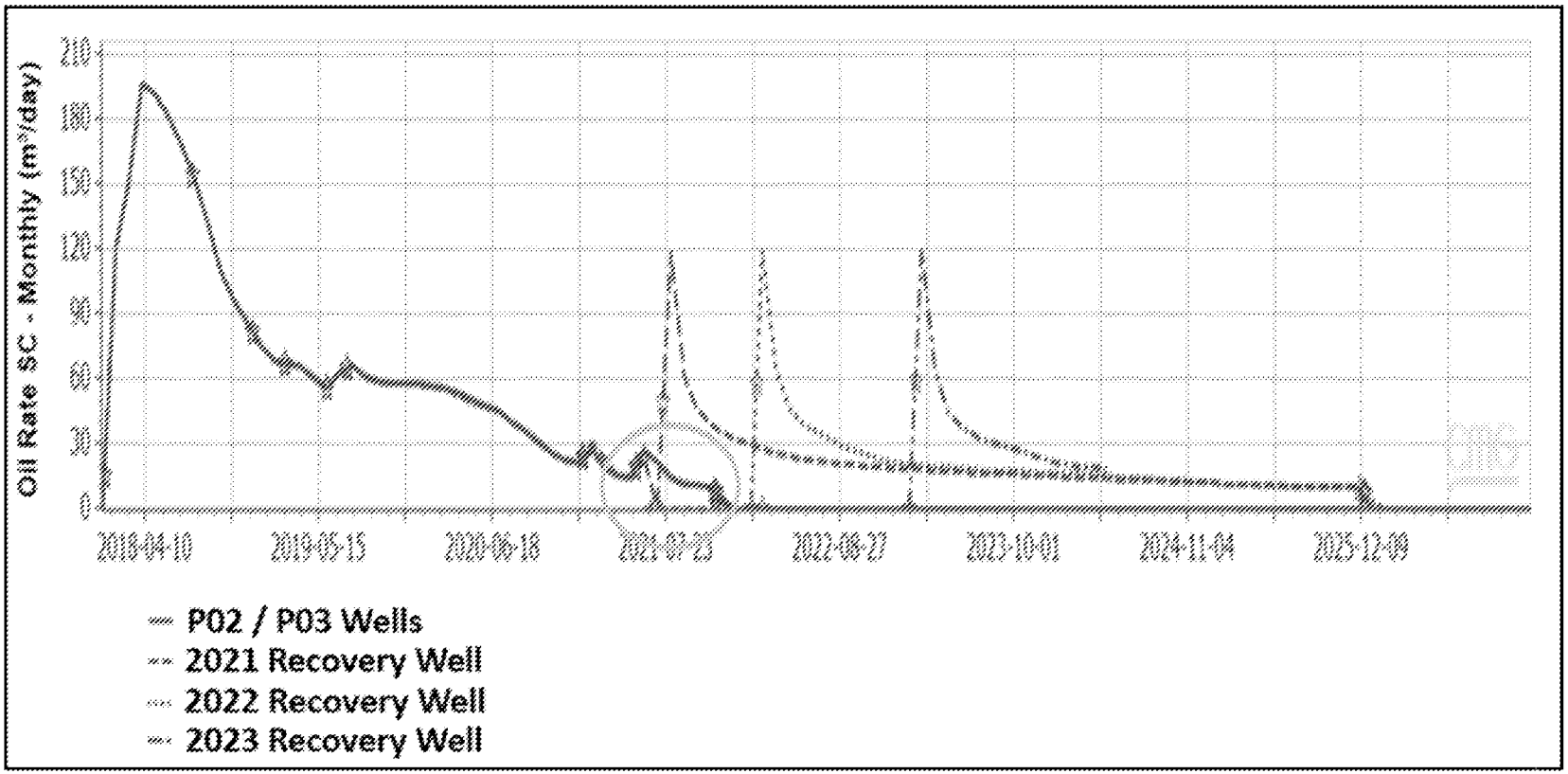
FIG. 6 is a graph showing the oil production rate of the first and second thermal recovery operations from wells P02 and P03, and plots showing simulated oil production for recovery well operations beginning in 2021 (before the end-of-life stage) and in 2022 and 2023 (both at the end-of-life stage).
Figure 7:
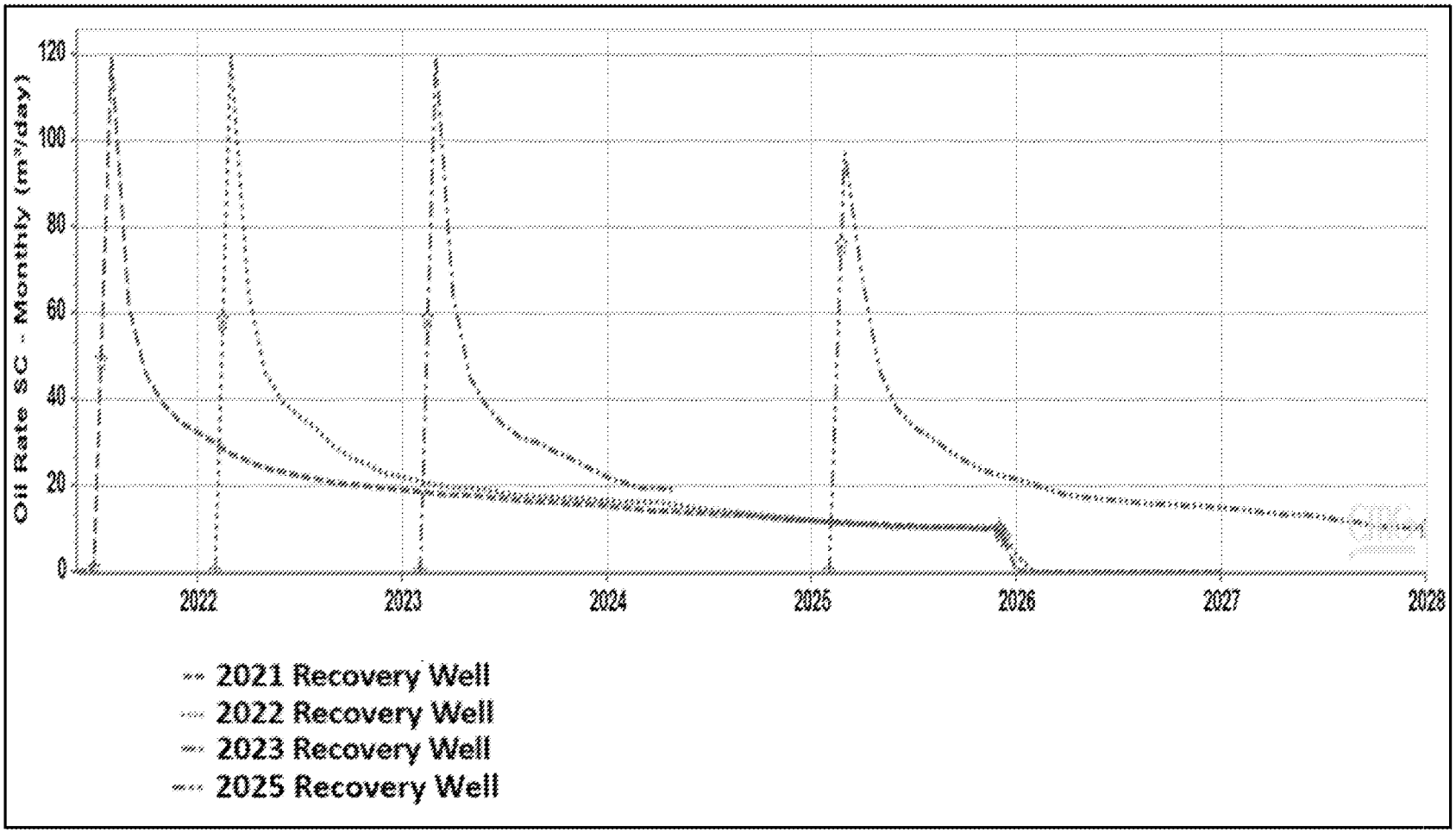
FIG. 7 is a graph showing simulated oil production rates for recovery well operations beginning in 2021 (before the end-of-life stage) and in 2022, 2023 and 2025 (during the end-of-life stage).
Figure 8:
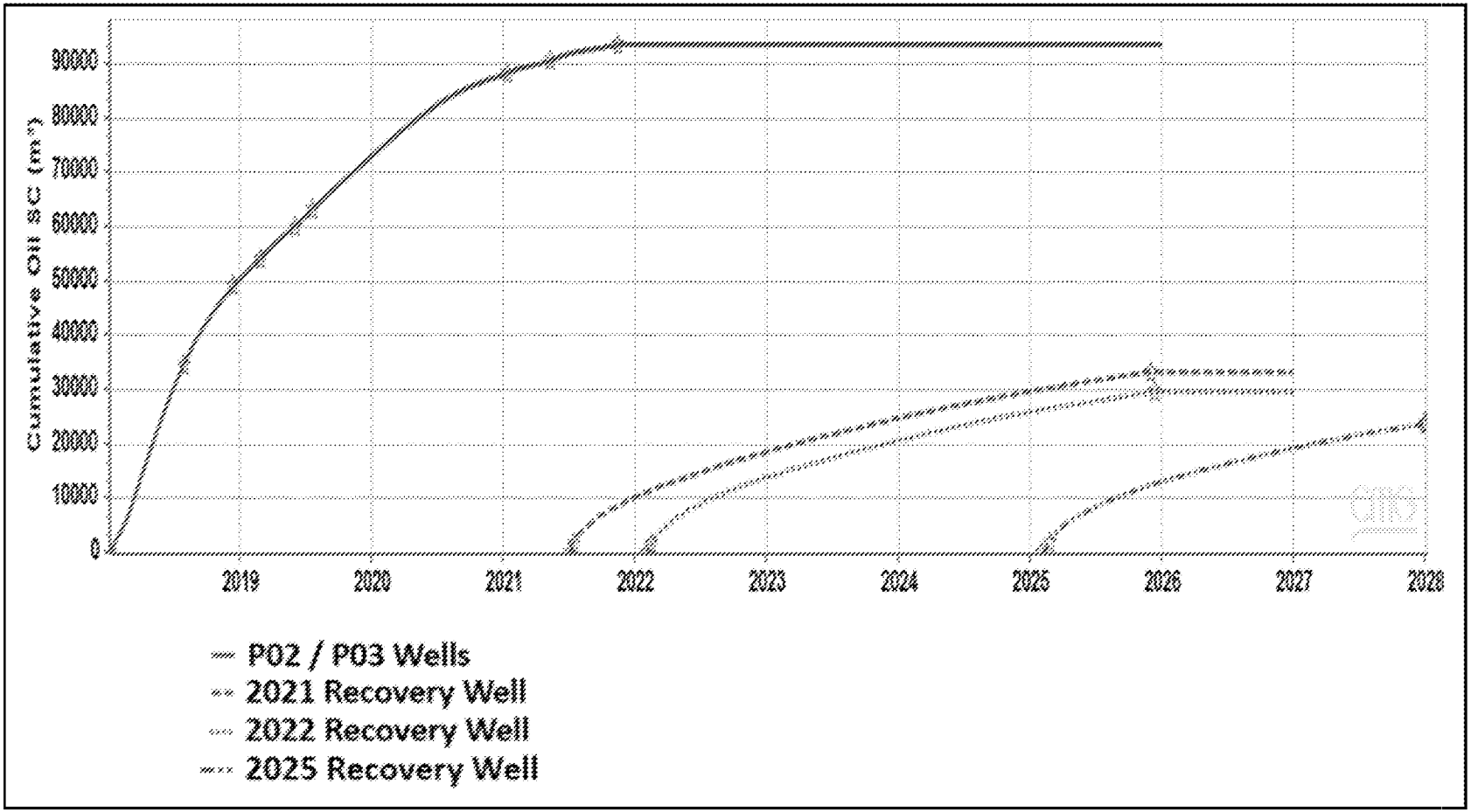
FIG. 8 is a graph showing the cumulative oil production ($m^3$) for the P02/P03 wells and the simulated cumulative oil production ($m^3$) for the 2021, 2022 and 2025 recovery wells.

A reservoir simulation history match study was conducted under various scenarios to determine the efficiency in recovering the heated hydrocarbon pay from the stranded pay zone. FIG. 6 shows the oil production rate of the first and second thermal recovery operations from wells P02 and P03, and plots oil production for a 2021 recovery well operated before the end-of-life stage (circled area) and oil production for recovery wells of the present disclosure (2022 and 2023 recovery wells) operated at an end-of-life stage after a production threshold is achieved (e.g., <5 $m^3$/day oil production, P02/P03 shut-in). FIG. 7 removes the oil production for the P02 and P03 wells and shows just the simulated oil production from the 2021, 2022 and 2023 recovery wells, together with a simulated oil production for a 2025 recovery well. The cumulative oil production ($m^3$) is shown in FIG. 8 for the P02/P03 wells and the 2021, 2022 and 2025 recovery wells.

Figure 9A:
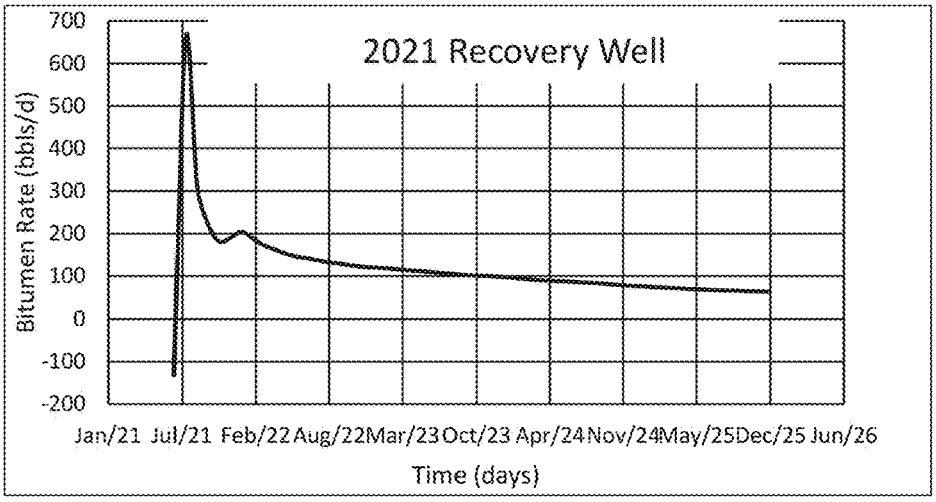
FIGS. 9A-9C show graphs depicting the simulated hydrocarbon recovery for end-of-life recovery from the 2021, 2022 and 2025 recovery wells.
Figure 9B:
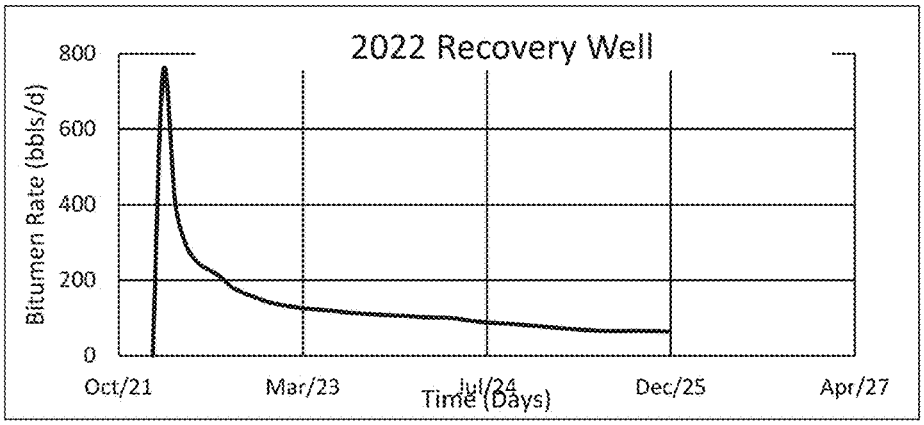
Figure 9C:
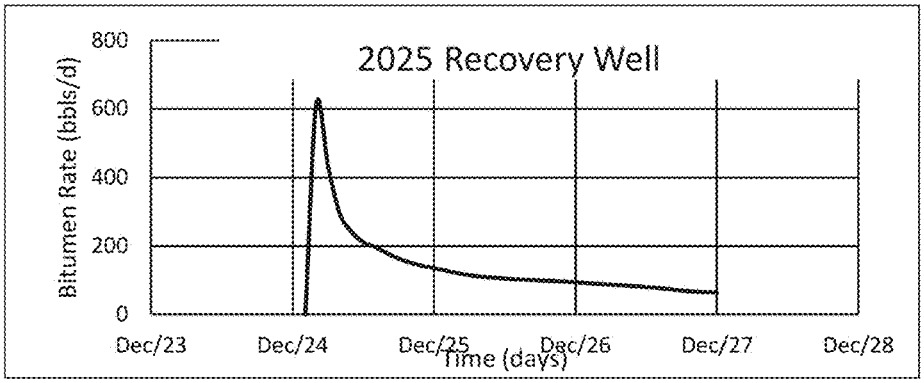

In FIGS. 9A-9C the simulated hydrocarbon recovery for the 2021 recovery well and the end-of-life recovery from the 2022 and 2025 recovery wells is shown. The total recovered barrels (Mbbl) are not substantially different for the 2021 and 2022 recovery wells at 195 Mbbl versus 187 Mbbl, respectively, despite the 2021 well being operated for a longer period of time. Notably, the 2021 recovery well begins in the negative to account for lost production from the first and second thermal recovery operations since the 2021 recovery commences before end-of-life. Production from the 2025 recovery well is lower at 151 Mbbl, indicating that the optimal window for beginning end-of-life recovery may nearing an end by this timeframe (e.g., 4-5 years after primary production has ceased).

The simulation shows that the stranded hydrocarbon pay can be produced economically as there is no incremental surface or steam injection costs. This resource cannot be accessed with parent producers due to low drainage angles during late life of SAGD project. Ideal time to drill an end-of-life recovery well is after the parent producer stops production during blowdown and before the reservoir temperature gets cooler (<60° C.) resulting in lower ultimate recovery. Although the cumulative production of the 2021 and 2022 recovery wells were about the same, production from the 2021 recovery well was over a longer period and includes stolen production from the P02 and P03 well pairs. In contrast, the end-of-life recovery wells (e.g., 2022) achieved nearly the same cumulative production in a shorter period of time, and without stealing production from the parent pairs (P02 and P03). By starting recovery before end-of-life, the hydrocarbon pay within the circle on FIG. 6 would be lost since the primary producers would need to be shut-in to commence end-of-life recovery.

In select embodiments of the methods disclosed herein, the stranded pay zone within the subterranean reservoir is an upper stranded pay zone located above one or more mobilized hydrocarbon zones of thermal recovery operations. In an embodiment, the upper pay zone may be within the same geological formation as the thermal recovery operation (e.g., same stratum of sand or sandstone). In an embodiment, the upper pay zone may be external to the zone of the thermal recovery operation (e.g., separated by a permeability barrier and/or in a different stratum of the subterranean reservoir).

During a typical thermal recovery operation, a production chamber will grow vertically via convection until a permeability barrier is reached. However, once this barrier is reached, heat will continue to transfer via conduction into the overburden and warm any fluids contained therein. Over time, and in accordance with embodiments of the methods disclosed herein, this heating is sufficient to mobilize hydrocarbons in a pay zone above the primary production chambers, but which for example due to a permeability barrier cannot flow down to the production well of the thermal recovery operations and remains trapped. In other embodiments, the upper pay zone may be within the zone of the thermal recovery operations, but stranded pay remains after the primary recovery operations.

In the methods disclosed herein, mobilized hydrocarbons in this upper stranded pay zone are recovered during an end-of-life stage after a production threshold is achieved for the thermal recovery operations. The end-of-life recovery using a recovery well as described herein is commenced only at the end-of-life stage of the thermal recovery operation, such that the SOR of the end-of-life recovery will be zero or near zero. By prolonged heating during the course of the effective life of the thermal recovery operations, the average temperature of the upper stranded pay zone will be high enough for production via the recovery well based substantially on latent heat energy. Moreover, the methods disclosed herein leverage existing infrastructure and generate incremental hydrocarbon production without substantial input of additional resources, thereby reducing overall emissions intensity.

Thus, in select embodiments, the present disclosure relates to a method of producing hydrocarbons from a subterranean reservoir, the method comprising: conducting a thermal recovery operation to recover mobilized hydrocarbons from a lower pay zone, the thermal recovery operation passively heating a stranded hydrocarbon pay in an upper stranded pay zone; providing a recovery well near or within the upper stranded pay zone; at an end-of-life stage after a production threshold is achieved for the thermal recovery operation from the lower pay zone, commencing an end-of-life recovery of mobilized hydrocarbons from the upper stranded pay zone by way of the recovery well; and producing hydrocarbons from the recovery well.

By "passively heating," it is intended to refer to a zone being heated indirectly by heat transfer from another zone in the reservoir that is being heated. Sufficient passive heating may derive from a single thermal recovery operation or multiple thermal recovery operations.

In some embodiments of the methods disclosed herein relating to recovery from an upper stranded pay zone, the methods may involve only a single thermal recovery operation. The thermal recovery operation would form a production chamber from which hydrocarbons are recovered (i.e., lower pay zone) during the thermal recovery operation. As above, during the thermal recovery operation, an upper pay zone of stranded hydrocarbon pay would be passively heated. In some embodiments, the thermal recovery operation a SAGD, CSS or SAP technique. In particular embodiments, the thermal recovery operation is a SAGD.

In other embodiments of the methods disclosed herein relating to recovery from an upper stranded pay zone, the upper stranded pay zone is heated by more than one thermal recovery operation. For example, the upper stranded pay zone may of sufficient size and/or configuration to be above two thermal recovery operations, each conducted from adjacent well pairs. In such instances, the upper stranded pay zone may be passively heated from both thermal recovery operations.

In some embodiments, the upper stranded pay zone or a substantial proportion thereof is directly above the mobilized hydrocarbon zone of a thermal recovery operation. By being directly above the lower pay zone, the upper stranded pay zone would typically receive a greater amount of passive heat as opposed to an upper zone that is offset from the lower pay zone. However, the ability of an upper zone to be passively heated by the thermal recovery operation may be dependent upon geological features, and therefore the upper stranded pay zone may not be directly above the lower pay zone.

In some embodiments, there is a barrier of impermeability between the lower pay zone and the upper stranded pay zone. By "barrier of impermeability," it is meant to refer to a geological formation having some distinct geological characteristic that at least partially reduces permeability between two or more zones in a formation. A barrier of impermeability may be of varying degrees of impermeability and/or continuity, for example preventing or impeding hydraulic flow between at least some portions of the zones under some reservoir conditions or serving as a semi-permeable barrier under select reservoir conditions that allows some degree of fluid mobility between the zones. In some embodiments of the methods herein, the barrier of permeability completely prevents fluid communication between the upper stranded pay zone and the lower pay zone. In some embodiments of the methods herein, the barrier of permeability partially blocks (reduces) fluid communication between the upper stranded pay zone and the lower pay zone. The barrier of permeability however does not block or prevent thermal communication between the upper stranded pay zone and the lower pay zone.

The upper stranded pay zone may be any distance above the lower pay zone provided that it is passively heated by the thermal recovery operation to a sufficient extent to mobilize the hydrocarbons within. In some embodiments, the bottom of the upper stranded pay zone is between about 0 m and about 30 m a horizontal well of the thermal recovery operations, more particularly between about 5 m and about 30 m. In other embodiments, the bottom of the upper stranded pay zone is at least 30 m above a horizontal well of the thermal recovery operations. In some embodiments, the bottom of the upper stranded pay zone is between about 30 m and about 75 m above a horizontal well of the thermal recovery operations, more particularly between about 35 m and about 50 m. In some embodiments, the bottom of the upper stranded pay zone is about 5 m, about 10 m, about 15 m, about 20 m, about 25 m, about 30 m, about 35 m, about 40 m, about 45 m, or about 50 m above a horizontal well of the thermal recovery operations. In an embodiment, the horizontal well is an injection well of the thermal recovery operation.

The vertical thickness of the upper stranded pay zone will be dependent upon the ability of the thermal recovery operation to passively heat the upper zone. This may be dependent upon any number of geological features. In some embodiments, the upper stranded pay zone has a thickness of at least 2 m. In some embodiments, the upper stranded pay zone has a thickness of between about 5 m and about 25 m, more particularly between about 5 m and about 15 m.

Figure 10:
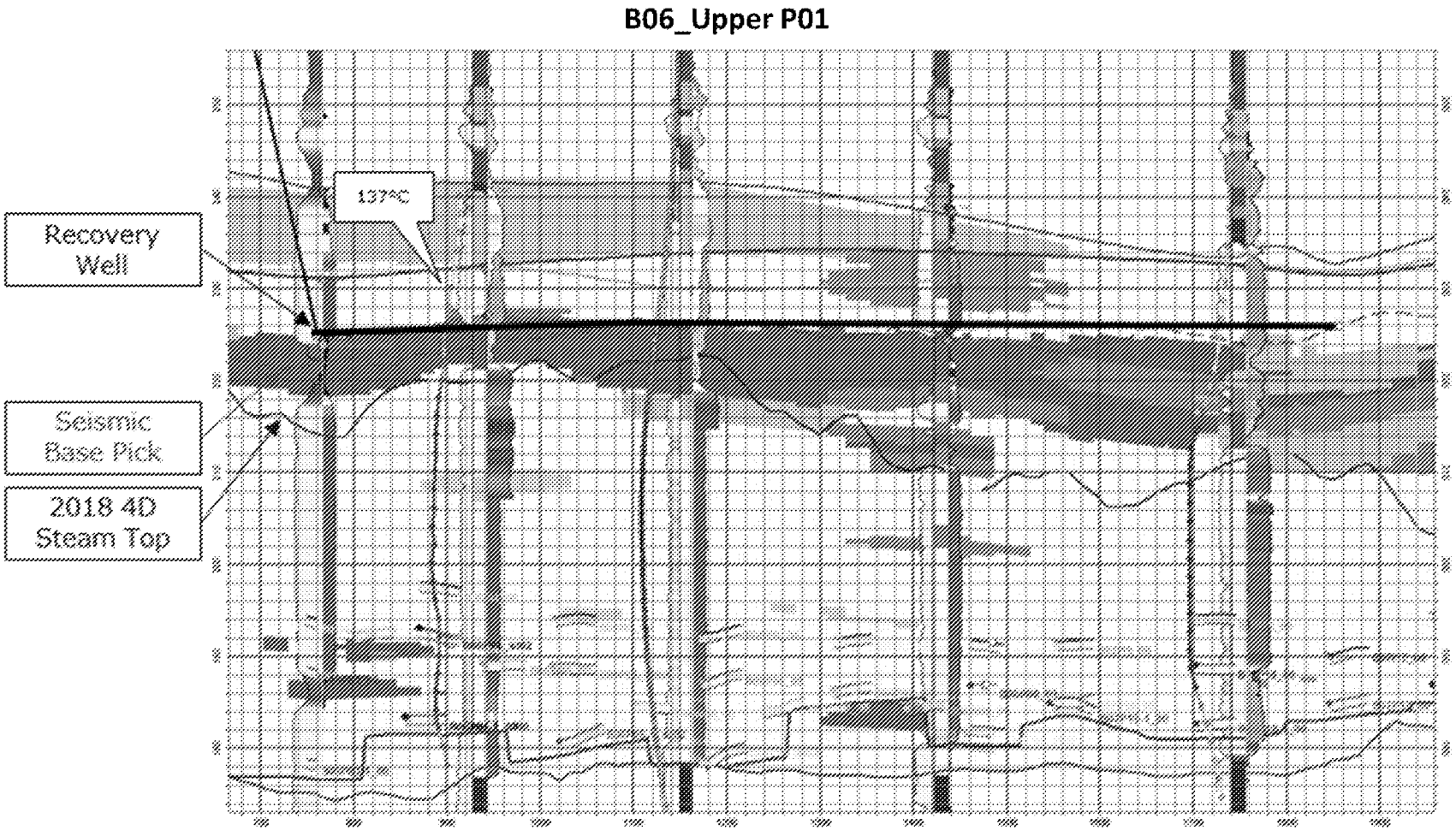
FIG. 10 is a schematic view in longitudinal cross-section showing the reservoir profile and an exemplary embodiment of a recovery well for end-of-life recovery from above a SAGD well pair.

To recover the mobilized hydrocarbons from an upper stranded pay zone, the recovery well may be of any suitable configuration. In some embodiments, the recovery well is drilled such that it is vertically spaced above a substantially horizontal portion of a production well of the thermal recovery operation. By this, it is meant that the recovery well is above and generally follows a parallel trajectory with the production well below it. The recovery well may, for example, be a branch drilled off a substantially vertical portion of the production well. In some embodiments, the recovery well is drilled from an existing surface location into the upper stranded pay zone. In either of these, or other configurations, the recovery well may be substantially horizontal, slanted in an upward direction, slanted in a downward direction, or any combination thereof over any particular length of the recovery well. In some embodiments, the recovery well is drilled in a manner such that it is generally positioned along or near the top of a barrier of impermeability (e.g., as shown in FIG. 10).

In accordance with various aspects of the disclosure, detailed computational simulations of end-of-life recovery of mobilized hydrocarbons in stranded pay zones above the production chambers of first and second thermal recovery operations may be carried out. The simulations test the feasibility of improving the energy efficiency of SAGD operations by utilizing heat trapped for zero steam-to-oil production of stranded hydrocarbon pay. The simulations involved embodiments of drilling and completing an end-of-life recovery well into a conductively heated upper pay zone at a particular well pad. This well pad includes 8 SAGD well pairs (P01-P08) with approximately 90 m spacing between the well pairs, about 1000 m well lengths, and no prior redevelopments.

The simulation tested the feasibility of recovering stranded hydrocarbon pay from an uppermost continuous sands zone at an end life stage after SAGD operations had ceased (well pad on blowdown). In the simulation, a horizontal well was placed above the primary SAGD pay zones in an area that had been heated through the primary recovery operation of SAGD well pairs. The reservoir profile and recovery well placement is shown in FIG. 10. The upper pay was estimated to contain 5-7 m of 80-140° C. of stranded hydrocarbon pay inaccessible from the SAGD production chambers.

Figure 11:
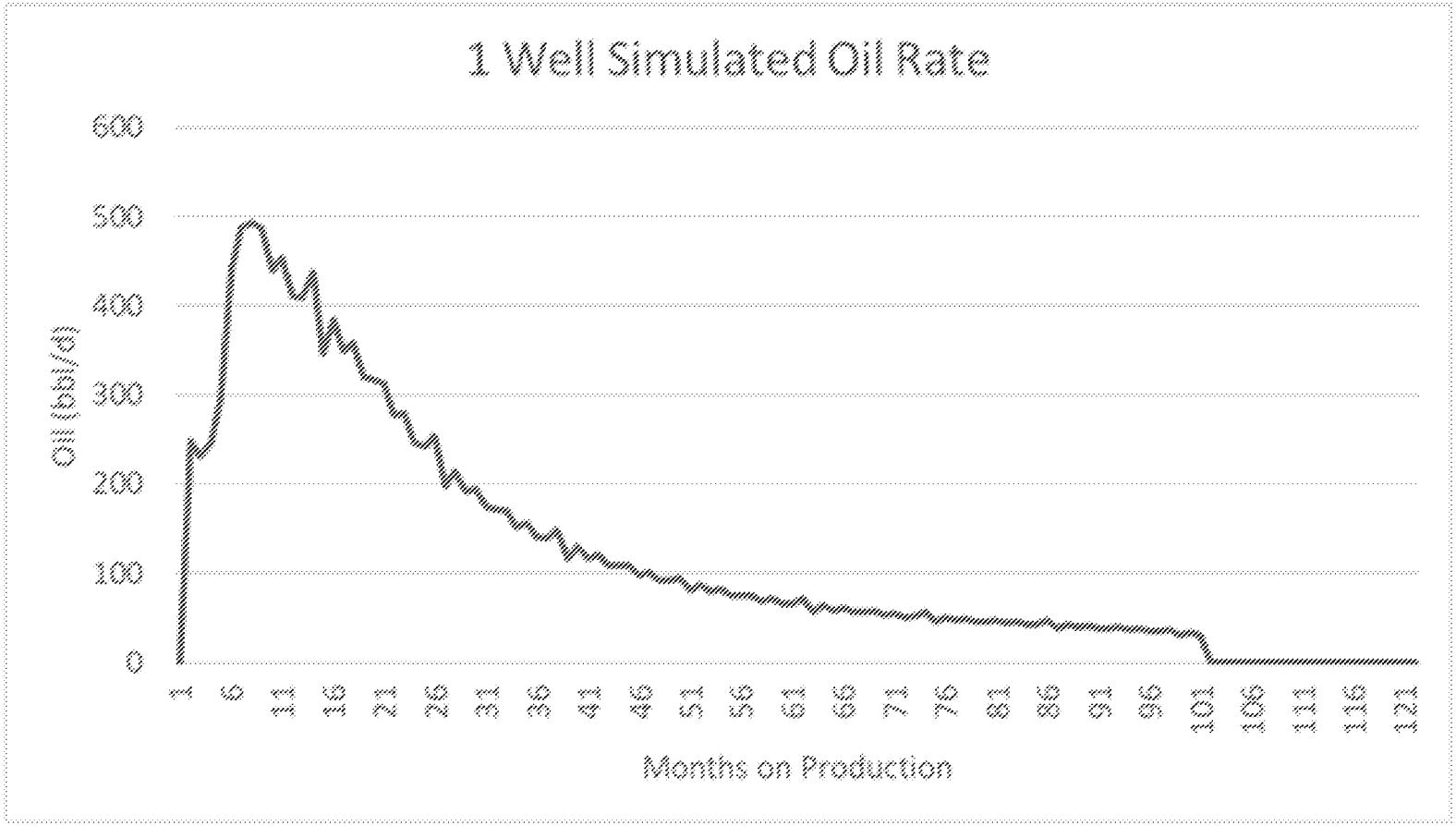
FIG. 11 is a graph showing end-of-life simulated oil production for an end-of-life recovery well placed in the upper pay zone.

Historic oil saturation and temperature profiles at the heel and mid-point of the SAGD well pair (P01) were used to identify and determine the depth and thickness of an upper pay zone showing significant conductive heating from the primary productions. At the upper pay zone above the P01 heel in 2020, oil saturation was found to be about 60% with an upper temperature of about 140° C. At the upper pay zone above the P01 mid-section in 2020, oil saturation was found to be about 60% with an upper temperature of about 120° C. End-of-life stage simulated oil production was determined for the recovery well placed in the upper pay zone above the P01 well pair (FIG. 11). The simulation does not account for any continued conductive heating from residual heat already present in the SAGD production chambers, so it is contemplated that the hydrocarbon production estimates may be lower than in actual practice.

The simulation shows that the stranded hydrocarbon pay can be produced economically as there is no incremental steam injection costs. This resource cannot be accessed with parent producers due to low permeability barriers. The ideal time to drill and operate the recovery well was after the parent producer stops production during blowdown and before the reservoir temperature gets cooler (<80° C.) resulting in lower ultimate recovery.

Without successfully leveraging the passively heated upper stranded pay zones in accordance with the end-of-life recovery methods disclosed herein, the hydrocarbon resource would either not be recovered or would be recovered using conventionally less efficient methods (e.g., thermal recovery techniques). The incremental hydrocarbon recovery during end-of-life stage, as disclosed herein, has the capability to improve resource utilization and, through the re-use of existing pads, also reduce the land footprint required for a given oil production. Recovery from stacked zones will become increasingly important as more complex reservoirs are developed.

In further select embodiments of the methods disclosed herein, the stranded pay zone within the subterranean reservoir is a lower stranded pay zone located below one or more mobilized hydrocarbon zones of thermal recovery operations. In an embodiment, the lower pay zone may be within the same geological formation as the thermal recovery operation (e.g., same stratum of sand or sandstone). In an embodiment, the lower pay zone may be external to the zone of the thermal recovery operation (e.g., separated by a permeability barrier and/or in a different stratum of the subterranean reservoir).

During a typical thermal recovery operation, a production chamber will most predominantly grow vertically upwards. Often however, at least a small fraction of the heat transfers downward in the reservoir. This may particularly be the case in reservoirs having one or more geological features that promote heat transfer downwards in the reservoir (e.g., confined primary pay zones, barriers, rock formations of higher heat conductivity, etc.). Over time, and in accordance with embodiments of the end-of-life recovery methods disclosed herein, this heating is sufficient to mobilize hydrocarbons in a pay zone below the primary production chambers. Moreover, in some embodiments, certain amounts of steam may be projected in a downwards direction in a late stage of the thermal recovery operation to further promote heating of a lower zone, which the purpose of utilizing the methods disclosed herein to capture mobilized hydrocarbons from such lower stranded pay zones.

In the methods disclosed herein, mobilized hydrocarbons in this lower stranded pay zone are recovered during an end-of-life stage after a production threshold is achieved for the thermal recovery operations. The end-of-life recovery using a recovery well as described herein is commenced only at the end-of-life stage of the thermal recovery operation, such that the SOR of the end-of-life recovery will be zero or near zero. By prolonged heating during the course of the effective life of the thermal recovery operations, the average temperature of the lower stranded pay zone will be high enough for production via the recovery well based substantially on latent heat energy. Moreover, the methods disclosed herein leverage existing infrastructure and generate incremental hydrocarbon production without substantial input of additional resources, thereby reducing overall emissions intensity.

Thus, in select embodiments, the present disclosure relates to a method of producing hydrocarbons from a subterranean reservoir, the method comprising: conducting a thermal recovery operation to recover mobilized hydrocarbons from an upper pay zone, the thermal recovery operation passively heating a stranded hydrocarbon pay in a lower stranded pay zone; providing a recovery well near or within the lower stranded pay zone; at an end-of-life stage after a production threshold is achieved for the thermal recovery operation from the upper pay zone, commencing an end-of-life recovery of mobilized hydrocarbons from the lower stranded pay zone by way of the recovery well; and producing hydrocarbons from the recovery well.

In some embodiments of the methods disclosed herein relating to recovery from a lower stranded pay zone, the methods may involve only a single thermal recovery operation. The thermal recovery operation would form a production chamber from which hydrocarbons are recovered (i.e., lower pay zone) during the thermal recovery operation. As above, during the thermal recovery operation, a lower pay zone of stranded hydrocarbon pay would be passively heated. In some embodiments, the thermal recovery operation a SAGD, CSS or SAP technique. In particular embodiments, the thermal recovery operation is a SAGD.

In other embodiments of the methods disclosed herein relating to recovery from a lower stranded pay zone, the lower stranded pay zone is heated by more than one thermal recovery operation. For example, the lower stranded pay zone may of sufficient size and/or configuration to be below two thermal recovery operations, each conducted from adjacent well pairs. In such instances, the lower stranded pay zone may be passively heated from both thermal recovery operations.

In some embodiments, the lower stranded pay zone or a substantial proportion thereof is directly below the mobilized hydrocarbon zone of a thermal recovery operation. By being directly below the upper pay zone, the lower stranded pay zone would typically receive a greater amount of passive heat as opposed to a lower zone that is offset from the upper pay zone. However, the ability of a lower zone to be passively heated by the thermal recovery operation may be dependent upon geological features, and therefore the lower stranded pay zone may not be directly below the upper pay zone.

In some embodiments, there is a barrier of impermeability between the upper pay zone and the lower stranded pay zone. In some embodiments of the methods herein, the barrier of permeability completely prevents fluid communication between the upper pay zone and the lower stranded pay zone. In some embodiments of the methods herein, the barrier of permeability partially blocks (reduces) fluid communication between the upper pay zone and the lower stranded pay zone. The barrier of permeability however does not block or prevent thermal communication between the upper pay zone and the lower stranded pay zone. In certain circumstances, it may be beneficial to select lower stranded pay zones that exhibit no fluid communication with the upper zone. For example, this may provide benefits such as reducing the chance of interference between the lower and primary pay zones.

The lower stranded pay zone may be any distance below the upper pay zone provided that it is passively heated by the thermal recovery operation to a sufficient extent to mobilize the hydrocarbons within. In some embodiments, the top of the lower stranded pay zone is at least 5 m below a horizontal well of the thermal recovery operations. In some embodiments, the top of the lower stranded pay zone is between about 5 m and about 50 m below a horizontal well of the thermal recovery operations, more particularly between about 10 m and about 25 m. In some embodiments, the top of the lower stranded pay zone is about 2 m, about 5 m, about 10 m, about 15 m, about 20 m, or about 25 m below a horizontal well of the thermal recovery operations. In an embodiment, the horizontal well is an injection well of the thermal recovery operation.

The vertical thickness of the lower stranded pay zone will be dependent upon the ability of the thermal recovery operation to passively heat the lower zone. This may be dependent upon any number of geological features. In some embodiments, the lower stranded pay zone has a thickness of at least 2 m. In some embodiments, the lower stranded pay zone has a thickness of between about 5 m and about 25 m, more particularly between about 5 m and about 15 m.

To recover the mobilized hydrocarbons from a lower stranded pay zone, the recovery well may be of any suitable configuration. In some embodiments, the recovery well is drilled such that it is vertically spaced below a substantially horizontal portion of a production well of the thermal recovery operation. By this, it is meant that the recovery well is below and generally follows a parallel trajectory with the production well above it. The recovery well may, for example, be a deepening off the existing production well. In some embodiments, the recovery well is drilled from an existing surface location into the lower stranded pay zone. In either of these, or other configurations, the recovery well may be substantially horizontal, slanted in an upward direction, slanted in a downward direction, or any combination thereof over any particular length of the recovery well.

In accordance with various aspects of the disclosure, detailed computational simulations of end-of-life recovery of mobilized hydrocarbons in stranded pay zones below the production chambers of first and second thermal recovery operations may be carried out. The simulations test the feasibility of improving the energy efficiency of SAGD operations by utilizing heat trapped for a zero to near zero steam-to-oil production of stranded hydrocarbon pay. The simulations involved embodiments of placing a recovery well into a conductively heated lower pay zone above below a primary production zone of a SAGD well pair at a particular well pad. The well pad includes 10 SAGD well pairs (P01-P10) with approximately 50 m spacing between the well pairs. There had been some redevelopments for well pairs P01-P04, where wedge wells had been drilled. The pad was on blowdown and there had been no redevelopments at well pair P10, which was used in this simulation.

Figure 12:
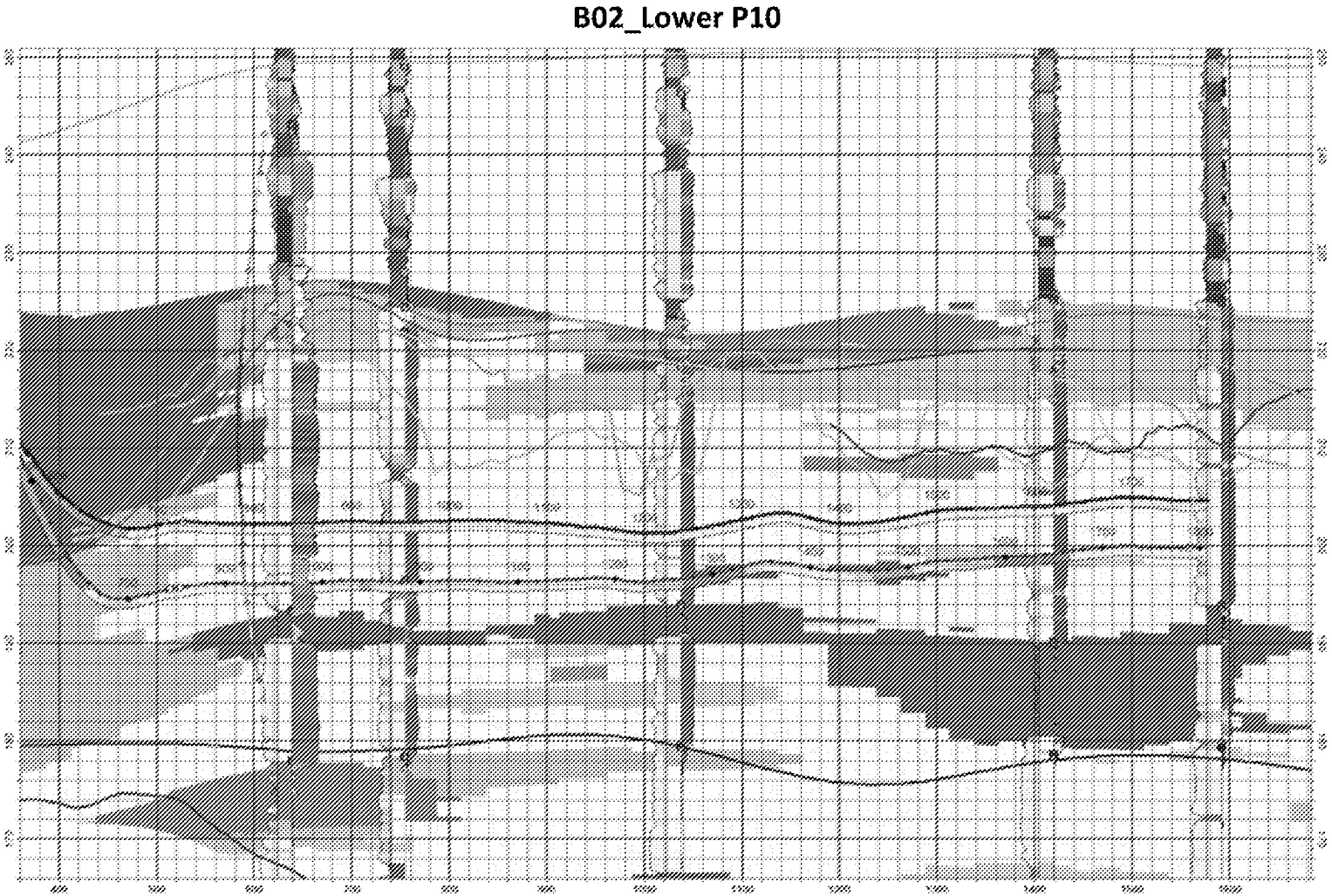
FIG. 12 is a schematic view in longitudinal cross-section showing the reservoir profile and an exemplary embodiment of a recovery well for end-of-life recovery from below a primary pay zone of a SAGD well pair.

In the simulation, a horizontal recovery well was placed below the primary SAGD pay zones in areas that had been heated through the prior operation of SAGD well pairs. The reservoir profile and recovery well placement below the P10 well pair is shown in FIG. 12. The lower pay was estimated to contain a significant volume of stranded hydrocarbon pay inaccessible from the SAGD production chambers.

Figure 13A:
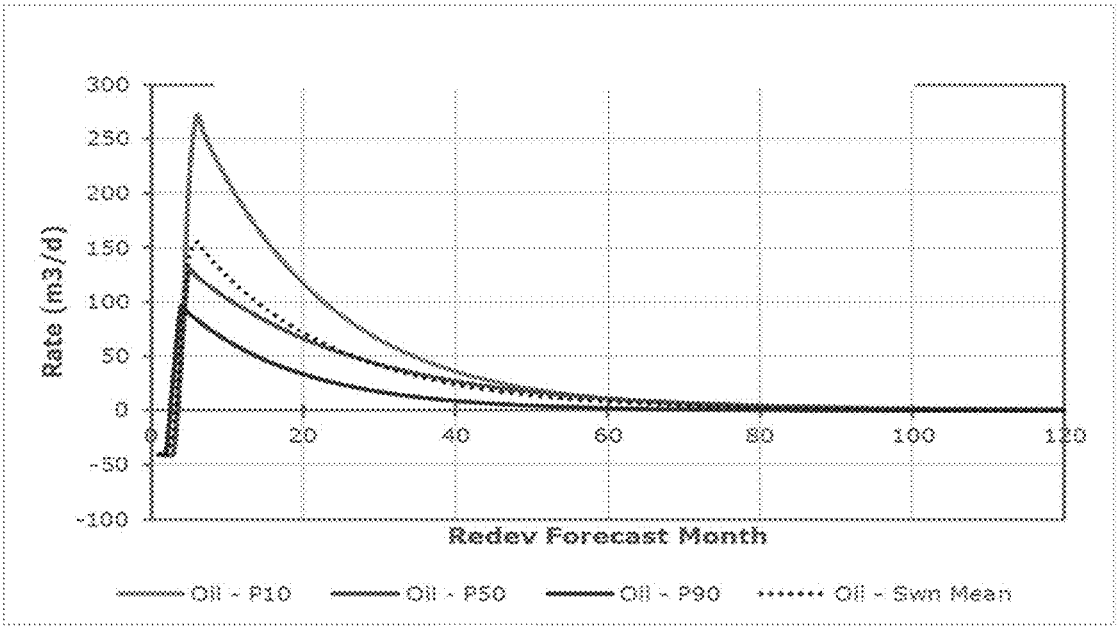
FIGS. 13A-13B depict graphs showing simulated oil production rate for end-of-life recovery from a lower pay zone below the SAGD well pair of FIG. 12.
Figure 13B:
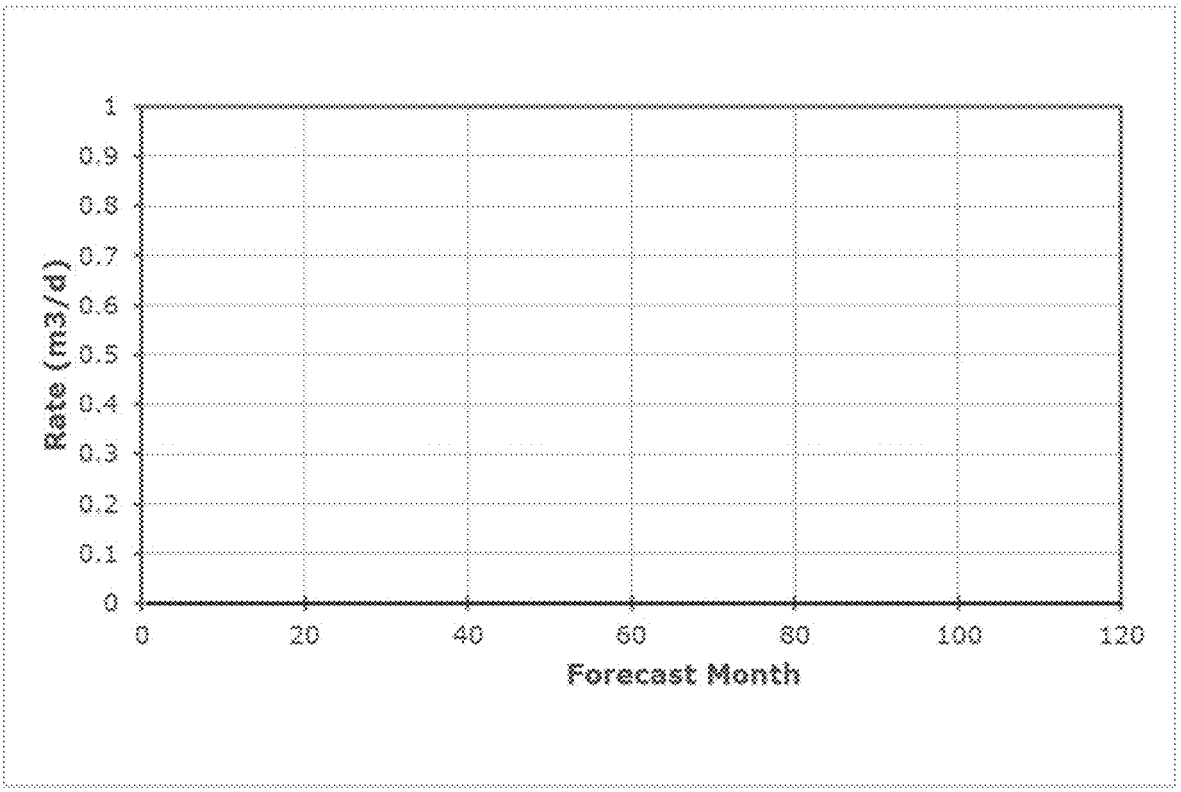

End-of-life stage simulated oil production was determined for the recovery well and is shown in FIG. 13A, which involved zero incremental steam injection as shown in FIG. 13B. The forecast was discounted to reflect the risk of bottom water (BW), mud barrier to chamber, and the fact that the pad is on blowdown. The simulation does not account for any continued conductive heating from residual heat already present in the SAGD production chambers, so it is contemplated that the hydrocarbon production estimates may be lower than in actual practice.

The simulation shows that the stranded hydrocarbon pay can be produced economically as there is no incremental steam injection costs. This resource cannot be accessed with parent producers due to low permeability barriers. Ideal time to drill a late life wedge well is after the parent producer stops production during blowdown and before the reservoir temperature cools (<80° C.) resulting in lower ultimate recovery.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method of producing hydrocarbons from a subterranean reservoir, the method comprising:

conducting a thermal recovery operation to recover mobilized hydrocarbons from a lower pay zone, the thermal recovery operation passively heating a stranded hydrocarbon pay in an upper stranded pay zone;

providing a recovery well near or within the upper stranded pay zone;

at an end-of-life stage after a production threshold is achieved for the thermal recovery operation from the lower pay zone, commencing an end-of-life recovery of hydrocarbons from the upper stranded pay zone by way of the recovery well, wherein latent heat energy from the thermal recovery operation that is present in the subterranean reservoir at the end-of-life stage is used to heat the hydrocarbons in the upper stranded pay zone and render them mobile and producible by way of the recovery well; and producing mobilized hydrocarbons recovered from the upper stranded pay zone from the recovery well.

2. The method of claim 1, wherein the production threshold comprises at least one:

a permanent cessation of steam injection for the thermal recovery operation;

an injection well for the thermal recovery operation being on gas injection only or being permanently shut-in;

an average drainage angle for mobilized hydrocarbons in the lower pay zone of 7° or less;

a hydrocarbon production rate from the thermal recovery operation of 5 $m^3$/day or less;

a gas/oil ratio (GOR) for produced hydrocarbons from the thermal recovery operation of at least 5; and a total recovery factor of hydrocarbons from the thermal recovery operation of at least 45%.

3. The method of claim 1, wherein:

the end-of-life stage is after hydrocarbon production from the thermal recovery operation has permanently ceased.

4. The method of claim 1, wherein:

the end-of-life recovery is without input of steam, gas, water, or any combination thereof, during the end-of-life stage.

5. The method of claim 1, wherein:

the end-of-life recovery is without input of sufficient steam from the recovery well to establish a hydraulic communication between the upper stranded pay zone and the lower pay zone.

6. The method of claim 1, wherein:

the end-of-life recovery is without input of sufficient steam from the recovery well to cause conductive heating of a region within the lower pay zone.

7. The method of claim 1, wherein:

the stranded hydrocarbon pay has an average temperature of at least 80° C.

8. The method of claim 1, wherein:

the upper stranded pay zone has a residual oil saturation of at least 60%.

9. The method of claim 1, wherein:

the providing of the recovery well is after the production threshold is achieved.

10. A method of producing hydrocarbons from a subterranean reservoir, the method comprising:

conducting a thermal recovery operation to recover mobilized hydrocarbons from an upper pay zone, the thermal recovery operation passively heating a stranded hydrocarbon pay in a lower stranded pay zone;

providing a recovery well near or within the lower stranded pay zone;

at an end-of-life stage after a production threshold is achieved for the thermal recovery operation from the upper pay zone, commencing an end-of-life recovery of hydrocarbons from the lower stranded pay zone by way of the recovery well, wherein latent heat energy from the thermal recovery operation that is present in the subterranean reservoir at the end-of-life stage is used to heat the hydrocarbons in the lower stranded pay zone and render them mobile and producible by way of the recovery well; and producing mobilized hydrocarbons recovered from the lower stranded pay zone from the recovery well.

11. The method of claim 10, wherein the production threshold comprises at least one of:

a permanent cessation of steam injection for the thermal recovery operation;

an injection well for the thermal recovery operation being on gas injection only or being permanently shut-in;

an average drainage angle for mobilized hydrocarbons in the upper pay zone of 7 degrees or less;

a hydrocarbon production rate from the thermal recovery operation of 5 $m^3$/day or less; a gas/oil ratio (GOR) for produced hydrocarbons from the thermal recovery operation of at least 5; and a total recovery factor of hydrocarbons from the thermal recovery operation of at least 45%.

12. The method of claim 10, wherein:

the end-of-life stage is after hydrocarbon production from the thermal recovery operation has permanently ceased.

13. The method of claim 10, wherein:

the end-of-life recovery is without input of steam, gas, water, or any combination thereof, during the end-of-life stage.

14. The method of claim 10, wherein:

the end-of-life recovery is without input of sufficient steam from the recovery well to establish a hydraulic communication between the lower stranded pay zone and the upper pay zone.

15. The method of claim 10, wherein:

the end-of-life recovery is without input of sufficient steam from the recovery well to cause conductive heating of a region within the upper pay zone.

16. The method of claim 10, wherein:

the stranded hydrocarbon pay has an average temperature of at least 80° C.

17. The method of claim 10, wherein:

the lower stranded pay zone has a residual oil saturation of at least 60%.

18. The method of claim 10, wherein:

the providing of the recovery well is after the production threshold is achieved.

19. A method of producing hydrocarbons from a subterranean reservoir, the method comprising:

conducting a thermal recovery operation from a well or a well pair, the thermal recovery operation forming a mobilized hydrocarbon zone;

providing a recovery well near or within a stranded pay zone, the stranded pay zone at an edge of the mobilized hydrocarbon zone;

at an end-of-life stage after a production threshold is achieved for the thermal recovery operation, commencing an end-of-life recovery of hydrocarbons from the stranded pay zone by way of the recovery well, wherein latent heat energy from the thermal recovery operation that is present in the subterranean reservoir at the end-of-life stage is used to heat the hydrocarbons in the stranded pay zone and render them mobile and producible by way of the recovery well; and producing mobilized hydrocarbons recovered from the stranded pay zone from the recovery well.

* * * * *